US011276959B2

(12) United States Patent
Iida et al.

(10) Patent No.: US 11,276,959 B2
(45) Date of Patent: Mar. 15, 2022

(54) ELECTRICAL CONNECTION DEVICE

(71) Applicant: J.S.T. Mfg. Co., Ltd., Tokyo (JP)

(72) Inventors: Marisa Iida, Osaka (JP); Hirotaka Mizuta, Osaka (JP)

(73) Assignee: J.S.T. MFG. CO., LTD., Tokyo (JP)

( * ) Notice: Subject to any disclaimer, the term of this patent is extended or adjusted under 35 U.S.C. 154(b) by 0 days.

(21) Appl. No.: 17/101,413

(22) Filed: Nov. 23, 2020

(65) Prior Publication Data

US 2021/0167550 A1 Jun. 3, 2021

(30) Foreign Application Priority Data

Nov. 29, 2019 (JP) ..... JP2019-216147

(51) Int. Cl.
*H01R 13/627* (2006.01)
*H01R 13/24* (2006.01)
*H01R 13/514* (2006.01)
*H01R 13/639* (2006.01)

(52) U.S. Cl.
CPC ..... *H01R 13/6272* (2013.01); *H01R 13/2407* (2013.01); *H01R 13/514* (2013.01); *H01R 13/639* (2013.01)

(58) Field of Classification Search
CPC ..... H01R 13/6272; H01R 13/2407; H01R 13/639
USPC ..... 439/354
See application file for complete search history.

(56) References Cited

U.S. PATENT DOCUMENTS 4,986,766 A * 1/1991 Leonard ..... H01R 13/6272 439/352
5,254,014 A * 10/1993 Yagi ..... H01R 13/6272 439/353
5,295,855 A * 3/1994 Walz ..... H01R 13/6272 285/319
5,584,719 A * 12/1996 Tsuji ..... H01R 13/6272 439/354
5,672,071 A * 9/1997 Ceru ..... H01R 13/6272 439/352
5,980,297 A * 11/1999 Sugie ..... H01R 13/6272 439/353
6,179,643 B1 * 1/2001 Fukuda ..... H01R 13/641 439/353
6,319,043 B1 * 11/2001 Takatsuki ..... H01R 13/6272 439/354

(Continued)

FOREIGN PATENT DOCUMENTS

JP 2014-207100 A 10/2014

*Primary Examiner* — Neil Abrams
(74) *Attorney, Agent, or Firm* — Kratz, Quintos & Hanson, LLP

(57) ABSTRACT

An electrical connection device includes a pair of connectors, namely a first connector and a second connector. The first connector includes a housing main body portion, a lock arm, and a cantilever portion. The second connector includes a lock receiving portion and an abutting portion. When the pair of connectors are in the unfitted state, the cantilever portion is located between the housing main body portion and the lock arm so as to be capable of supporting the lock arm. The abutting portion comes into contact with the cantilever portion when the pair of connectors are fitted together, and therefore the cantilever portion undergoes elastic displacement to a position that allows the lock arm to flex toward the housing main body portion.

7 Claims, 19 Drawing Sheets

(56) References Cited

U.S. PATENT DOCUMENTS

| | | | | |
|---|---|---|---|---|
| 6,371,796 | B2 * | 4/2002 | Fukuda | H01R 13/641 439/188 |
| 7,214,085 | B2 * | 5/2007 | Ohtaka | H01R 13/6273 439/352 |
| 8,777,651 | B2 * | 7/2014 | Miyawaki | H01R 13/6272 439/354 |
| 9,312,635 | B2 * | 4/2016 | Yagi | H01R 13/6272 |
| 9,318,836 | B2 * | 4/2016 | Yagi | H01R 13/502 |
| 9,368,909 | B2 * | 6/2016 | Yagi | H01R 13/6272 |
| 11,121,497 | B2 * | 9/2021 | Nagasaka | H01R 13/506 |
| 2021/0167550 | A1 * | 6/2021 | Iida | H01R 13/2407 |

* cited by examiner

ELECTRICAL CONNECTION DEVICE

CROSS-REFERENCE TO RELATED APPLICATION

This application claims priority to Japanese Patent Application No. 2019-216147. The entire disclosure of Japanese Patent Application No. 2019-216147 is hereby incorporated herein by reference.

BACKGROUND OF THE INVENTION

1. Field of the Invention

The present invention relates to an electrical connection device that includes a pair of connectors that can be fitted together.

2. Description of Related Art

Generally in an electrical connection device that includes a pair of connectors that can be fitted together, one of the connectors is provided with a lock arm that can undergo flexing displacement toward the main body portion of that connector, and the other connector is provided with a lock receiving portion. When the pair of connectors are fitted together, the lock arm of the one connector engages with the lock receiving portion of the other connector thus restricting separation of the one connector from the other connector.

The aforementioned lock arm is generally made of a resin material, and if the lock arm is subjected to a load when in a high-temperature environment, there are cases where the lock arm deforms due to resin creep and thus loses strength. If the lock arm loses strength, the lock functionality is not sufficiently exhibited, and problems such as the one connector easily separating from the other connector can occur.

In light of the aforementioned problem, JP 2014-207100A discloses technology for providing a semi-lock portion that engages with lock arm so as to allow flexing displacement of the lock arm if the lock arm is subjected to a predetermined amount of operation force or higher, for example.

SUMMARY OF THE INVENTION

However, in the technology described in JP 2014-207100A, if excessive pushing force acting toward the main body portion is applied to the lock arm due to some sort of reason while the pair of connectors are transported in the unfitted state for example, there is a risk that the lock arm will move beyond the semi lock portion and flex excessively toward the main body portion, and thus lose strength. Furthermore, once the lock arm enters a state of being engaged with the semi lock portion (also called the semi-locked state), unless the operator cancels the semi-locked state, the lock arm remains in the semi-locked state, and the lock arm continues to lose strength.

Here, a configuration is conceivable in which the protruding height of the semi lock portion is set higher in order to prevent the case where the lock arm engages with the semi lock portion when subjected to excessive pushing force during transport or the like. However, with this configuration, the worker needs to apply a large amount of force in order to engage the lock arm with the semi lock portion or cancel the semi-locked state, and it becomes more difficult to fit the pair of connectors together and pull them apart, and therefore the above configuration is not practical.

Note that the problem of the loss of strength of the lock arm in a pair of connectors in the unfitted state is not limited to occurring in a connector provided with a semi lock portion as described in JP 2014-207100A, and can also occur in a connector that is not provided with a semi lock portion. For example, if excessive pushing force acting toward the main body portion is applied to the lock arm due to some sort of reason while the pair of connectors are transported in the unfitted state for example, the lock arm can possibly flex excessively toward the main body portion and thus lose strength.

With the technology disclosed in JP 2014-207100A, when fitting the pair of connectors together, the worker needs to first insert one of the connectors into the other connector, and then cancel the restriction of the lock arm by the semi lock portion.

In this way, with the technology disclosed in JP 2014-207100A, multiple operations need to be performed when fitting the pair of connectors together.

In light of the foregoing circumstances, an object of the present invention is to provide an electrical connection device that can prevent the loss of strength of a lock arm in a pair of connectors in an unfitted state, and also facilitate the operation of fitting the pair of connectors together.

(1) In order to solve the foregoing problems, an electrical connection device according to an aspect of the present invention includes: a first connector that is one of a pair of connectors that can be fitted together; and a second connector that is another one of the pair of connectors, wherein the first connector includes a housing main body portion, a lock arm provided on the housing main body portion so as to be capable of flexing, and a cantilever portion that extends from the housing main body portion or the lock arm in a cantilevered manner and is capable of elastic displacement, the second connector includes a lock receiving portion configured to engage with the lock arm, and an abutting portion configured to come into contact with the cantilever portion when the pair of connectors are fitted together, when the pair of connectors are in an unfitted state, the cantilever portion is located between the housing main body portion and the lock arm so as to be capable of supporting the lock arm, and due to the abutting portion coming into contact with the cantilever portion when the pair of connectors are fitted together, the cantilever portion becomes elastically displaced to a position that allows the lock arm to flex toward the housing main body portion.

According to this configuration, when the pair of connectors are in the unfitted state, the cantilever portion is located between the housing main body portion and the lock arm of the first connector so as to be capable of supporting the lock arm. For this reason, even if excessive pushing force acting toward the first housing main body portion is applied to the lock arm of the pair of connectors while the pair of connectors are transported in the unfitted state for example, the cantilever portion prevents the lock arm from excessively flexing toward the first housing main body portion. Accordingly, it is possible to suppress the loss of strength of the lock arm in the pair of connectors in the unfitted state.

Also, when the pair of connectors are fitted together, the cantilever portion elastically deforms due to the abutting portion coming into contact with the cantilever portion, and flexing of the lock arm is allowed. Due to the elastic force of the lock arm that can flex relative to the housing main body portion, the lock arm then engages with the lock receiving portion of the second connector. For this reason, the worker does not need to perform multiple operations, and can fit the pair of connectors together through a single operation. Accordingly it is possible to facilitate the operation of fitting the pair of connectors together.

As described above, according to the above configuration, it is possible to provide an electrical connection device that can prevent the loss of strength of the lock arm in a pair of connectors in an unfitted state, and also facilitate the operation of fitting the pair of connectors together.

(2) A configuration is possible in which the housing main body portion includes a recession portion that is provided in a portion that faces the lock arm and configured to house the cantilever portion, and the cantilever portion is configured to undergo elastic displacement to the position that allows the lock arm to flex toward the housing main body portion, and is configured to thereafter become displaced toward the housing main body portion and housed in the recession portion when the lock arm flexes toward the housing main body portion.

According to this configuration, when the pair of connectors are in the unfitted state, the cantilever portion is located between the housing main body portion and the lock arm, and when the pair of connectors are fitted together, the cantilever portion becomes housed in the recession portion provided in the portion of the housing main body portion that faces the lock arm. For this reason, the cantilever portion is not located at a position protruding from the portion that faces the lock arm when the pair of connectors are fitted together. Accordingly the cantilever portion is compactly provided in the first connector in a space-efficient manner, and it is possible to achieve a reduction in the size of the first connector that includes the cantilever portion.

(3) A configuration is possible in which the cantilever portion is provided on the lock arm.

According to this configuration, the cantilever portion can become displaced in the flexing direction of the lock arm without the cantilever portion being provided with a separate configuration for flexing in that flexing direction, and therefore the flexing of the cantilever portion in the flexing direction of the lock arm can be realized with a simple configuration.

(4) A configuration is possible in which the cantilever portion is provided on a base portion of the lock arm.

According to this configuration, it is possible to maximize the distance between the fixed end and the free end of the cantilever portion. As a result, when the abutting portion comes into contact with the free-end-side portion of the cantilever portion, the cantilever portion can easily undergo elastic deformation, and the worker can fit the pair of connectors together with relatively little force.

(5) A configuration is possible in which a rib provided on the second connector also functions as the abutting portion, the lock arm is provided with a rib groove, and due to the rib being inserted into the rib groove when the pair of connectors are fitted together, the rib serving as the abutting portion comes into contact with the cantilever portion, and the cantilever portion becomes elastically displaced to the position that allows the lock arm to flex toward the housing main body portion.

According to this configuration, elastic displacement of the cantilever portion is realized with use of the rib provided in the second connector and the rib groove provided in the lock arm of the first connector. Accordingly there is no need to provide a new configuration for realizing elastic displacement of the cantilever portion, thus making it possible to suppress an increase in cost when manufacturing the pair of connectors.

(6) A configuration is possible in which the cantilever portion is shaped such that a width of the cantilever portion increases from a fixed end side of the cantilever portion toward a free end side of the cantilever portion.

According to this configuration, the first connector can be molded through simultaneous molding performed using a two-piece mold that includes only an upper mold and a lower mold. In other words, there is no need for a slide core to be combined with the upper mold and the lower mold when forming a cavity for molding of the first connector in the mold. Accordingly, it is possible to suppress an increase in the cost of the mold for molding the first connector.

(7) A configuration is possible in which the cantilever portion is provided on the housing main body portion, the second connector is provided with a recession portion configured to house the cantilever portion, and the cantilever portion is configured to be housed in the recession portion due to undergoing elastic displacement to the position that allows the lock arm to flex toward the housing main body portion.

According to this configuration, the cantilever portion need only be shaped so as to be capable of undergoing elastic displacement to a position that allows the lock arm to flex toward the first housing main body portion and the cantilever portion can be designed with a high degree of freedom.

Note that the above and other objects, features, and advantages of the present invention will become apparent by reading the following description with the attached drawings.

BRIEF DESCRIPTION OF THE DRAWINGS

FIG. 8A is a conceptual diagram showing the state of the cantilever portion in the unfitted state, and FIG. 8B is a conceptual diagram showing the state of the cantilever portion during the fitting operation.

12B is a diagram of the first connector according to the second embodiment as viewed from ahead.

Figure 13:
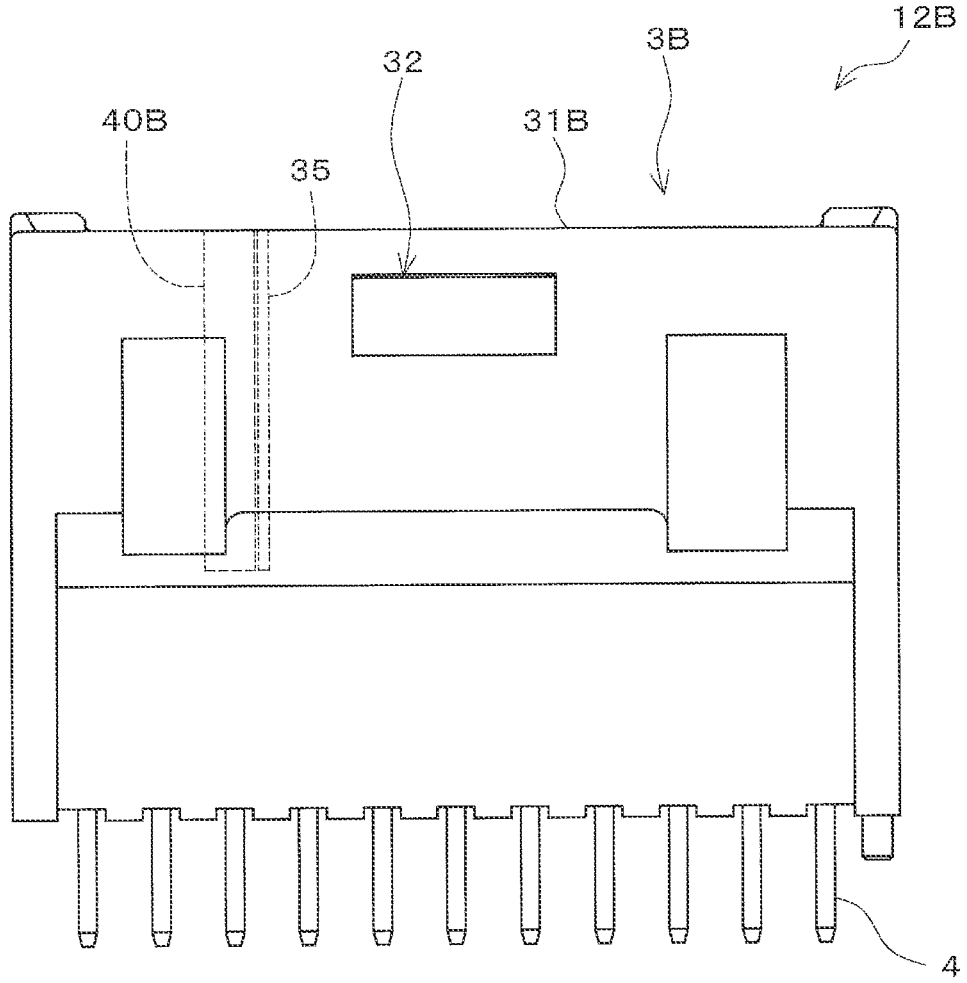
Figure 13:
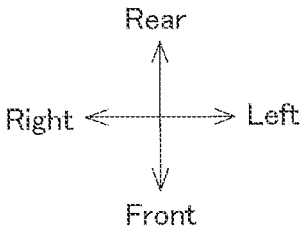

FIG. 13 is a diagram of a second connector according to the second embodiment as viewed from above.

Figure 14:
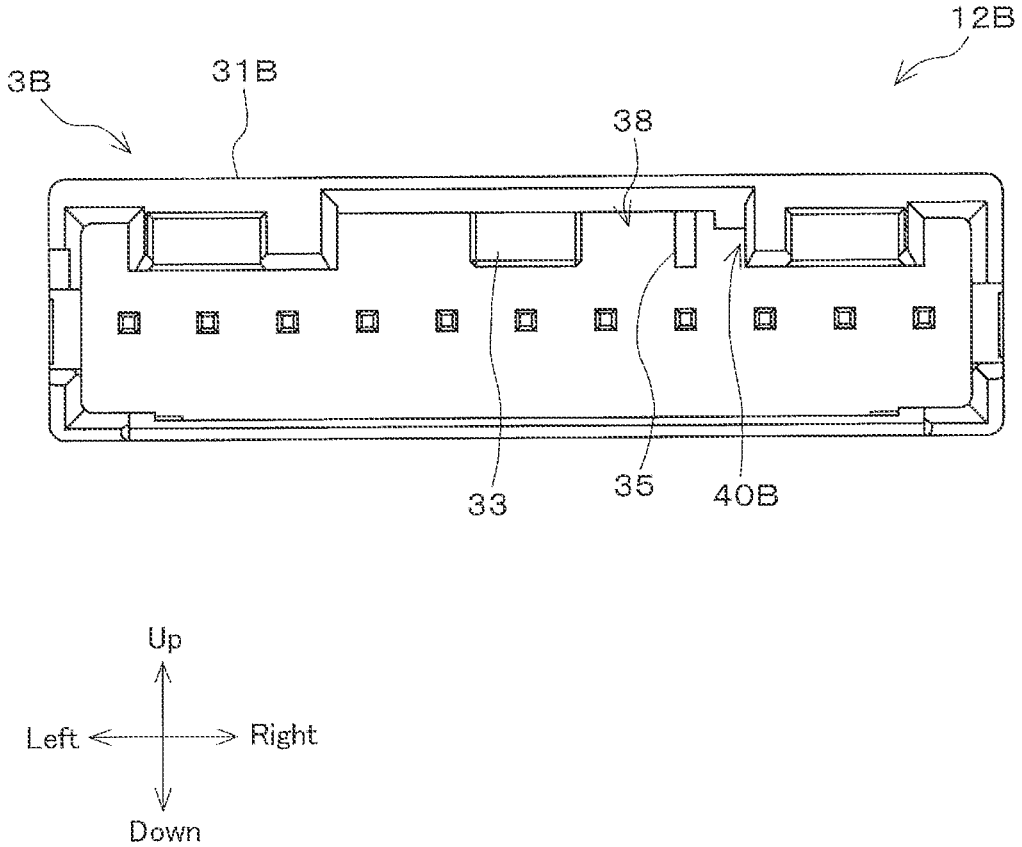

FIG. 14 is a diagram of the second connector according to the second embodiment as viewed from behind.

Figure 15:
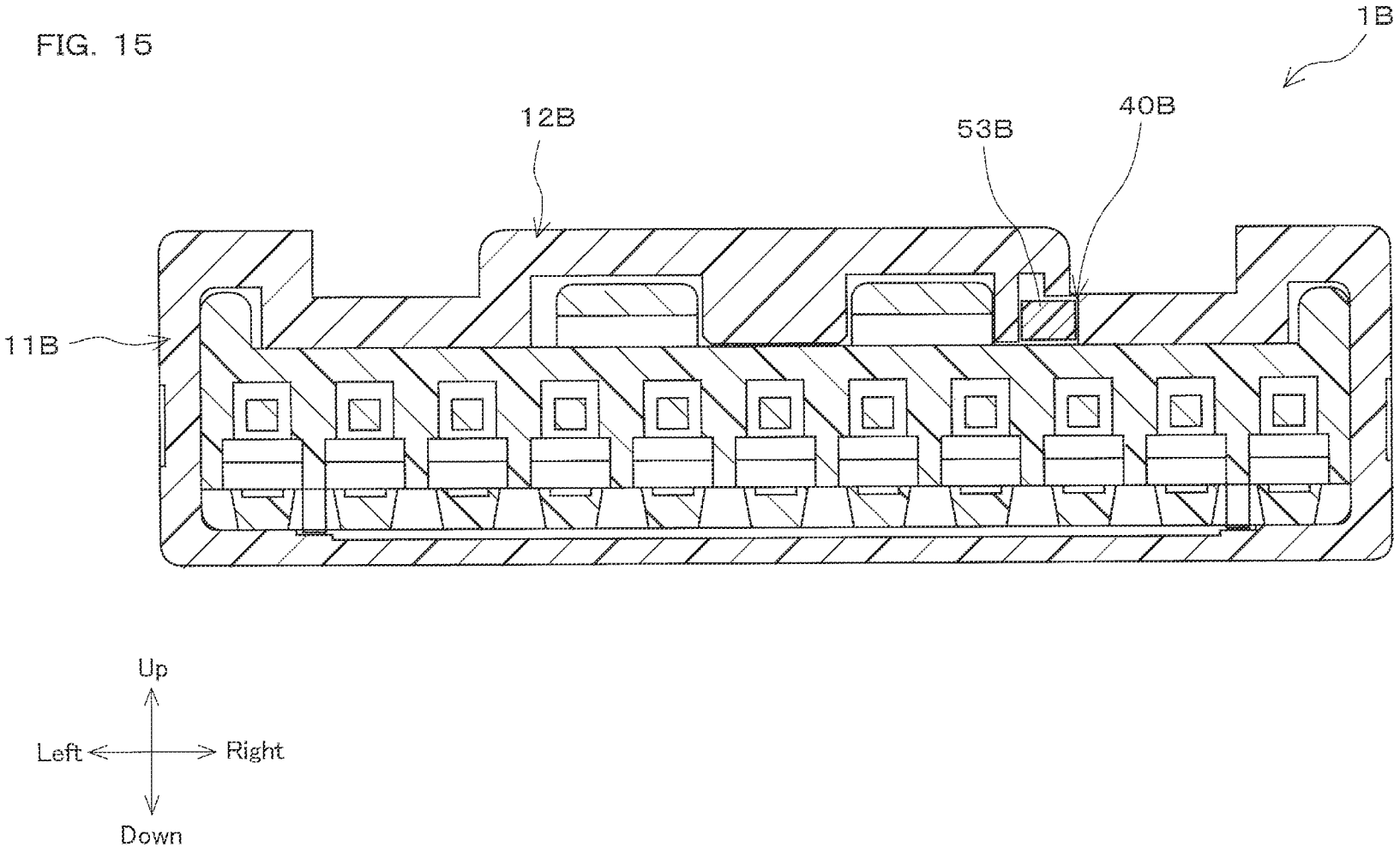

FIG. 15 is a cross-sectional view of the pair of connectors according to the second embodiment from behind, and shows the state in which the cantilever portion is housed in a recession portion.

Figure 16:
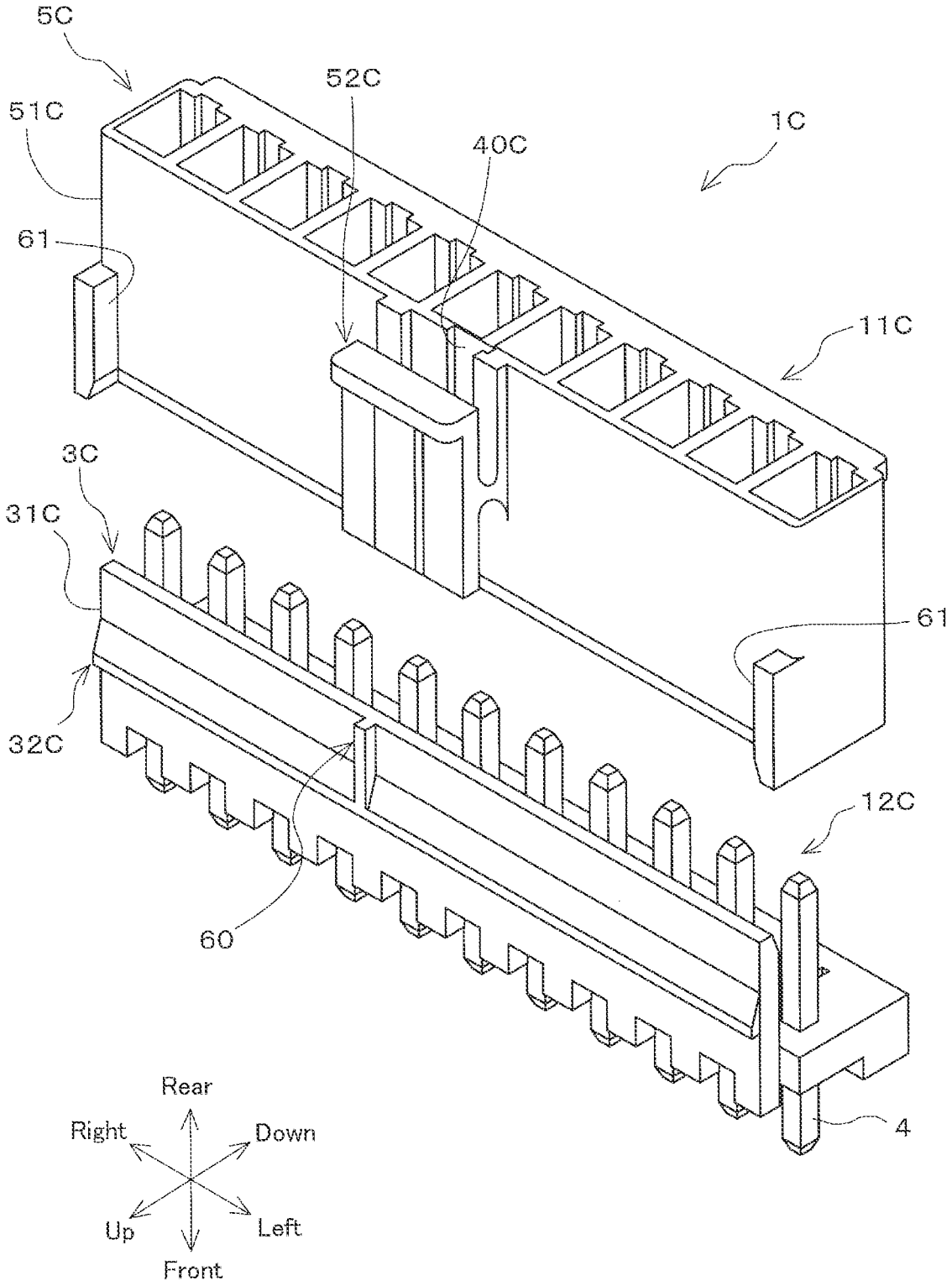

FIG. 16 is a perspective view of an electrical connection device according to a variation before fitting (unfitted state).

Figure 17A:
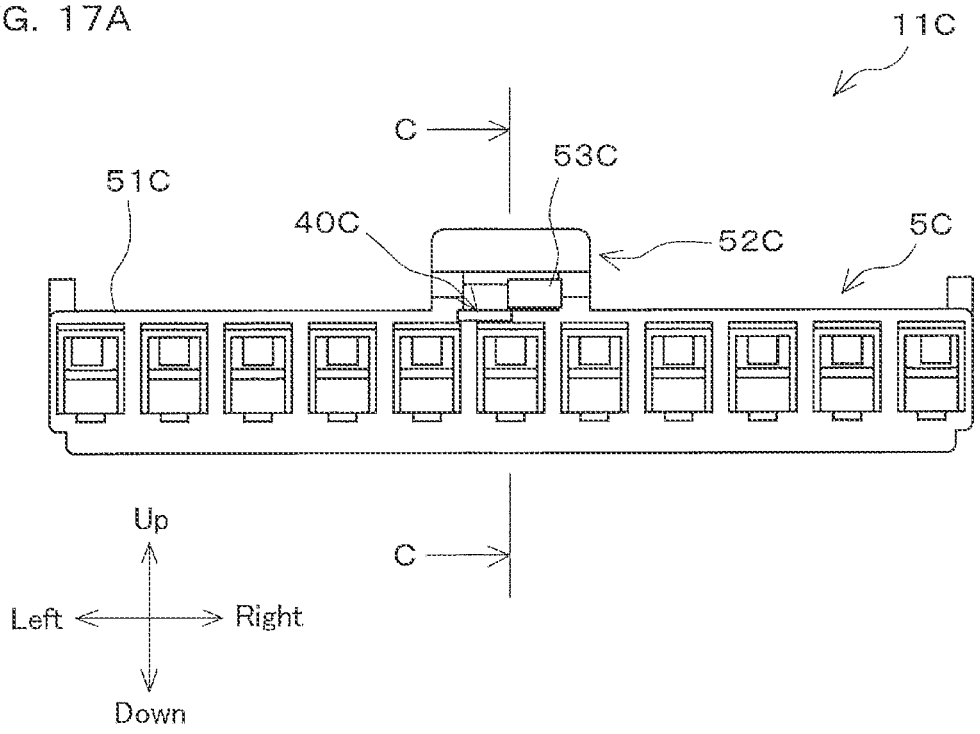
Figure 17B:
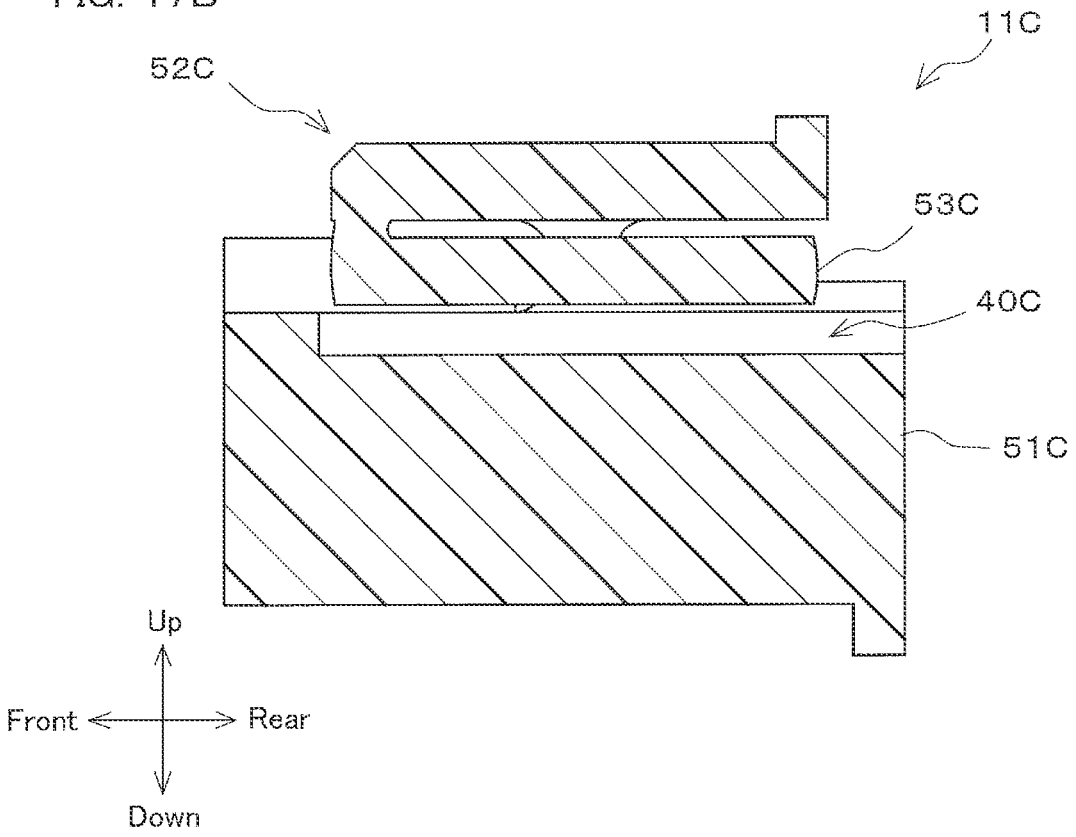

FIG. 17A is a diagram of a first connector according to the variation as viewed from behind, and FIG. 17B is a cross-sectional view of the first connector shown in FIG. 17A taken along arrows C-C.

Figure 18:
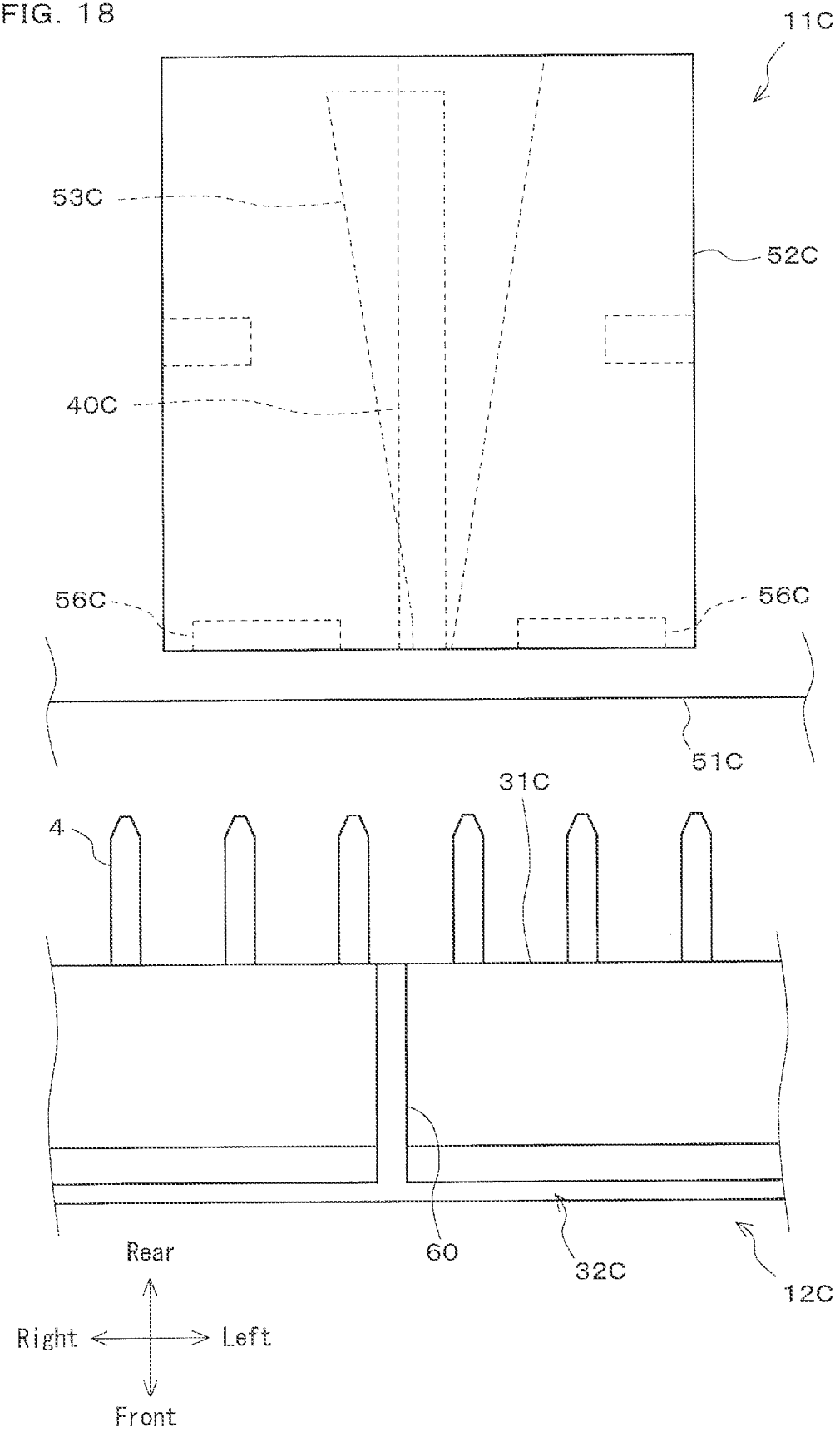

FIG. 18 is a conceptual diagram showing operations of the cantilever portion in a connector fitting operation according to the variation (unfitted state).

Figure 19:
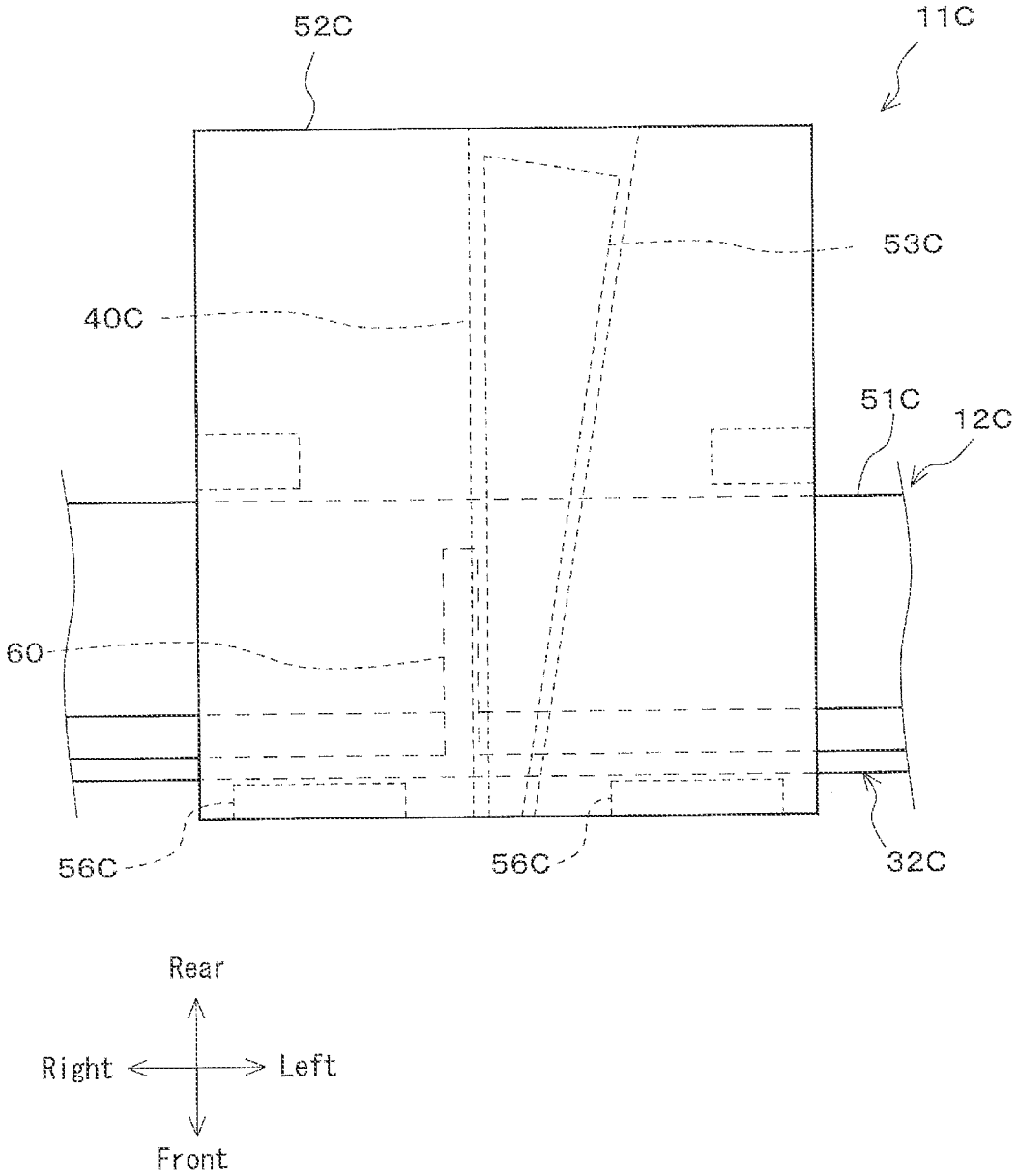

FIG. 19 is a conceptual diagram showing operations of the cantilever portion in a connector fitting operation according to the variation (fitted state).

DETAILED DESCRIPTION OF THE INVENTION

The following describes modes for carrying out the present invention with reference to the drawings. Note that the present invention is broadly applicable in various applications as an electrical connection device that includes a pair of connectors that can be fitted to each other.

First Embodiment

Figure 1:
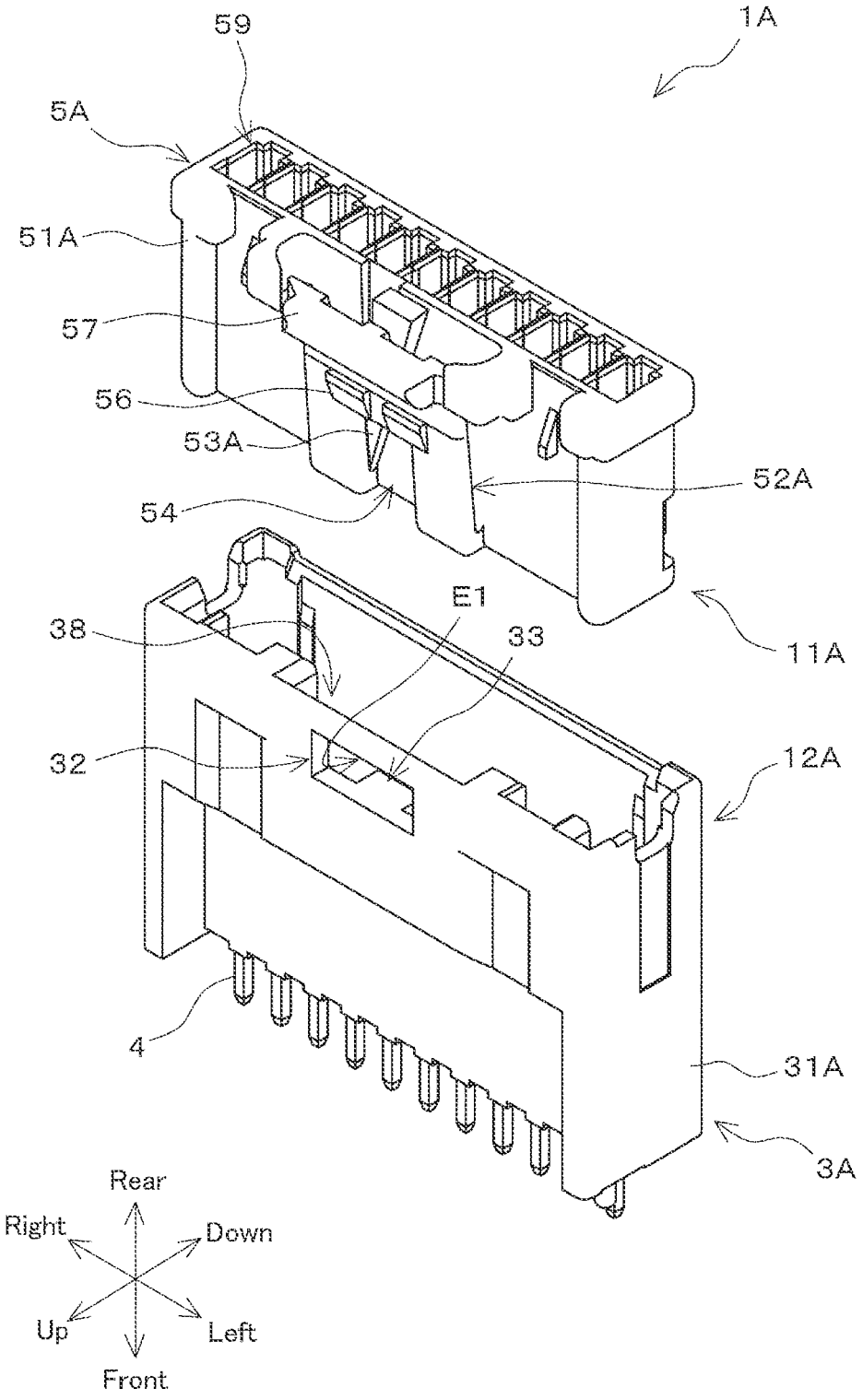
FIG. 1 is a perspective view of an electrical connection device according to an embodiment of the present invention before fitting (unfitted state).
Figure 2:
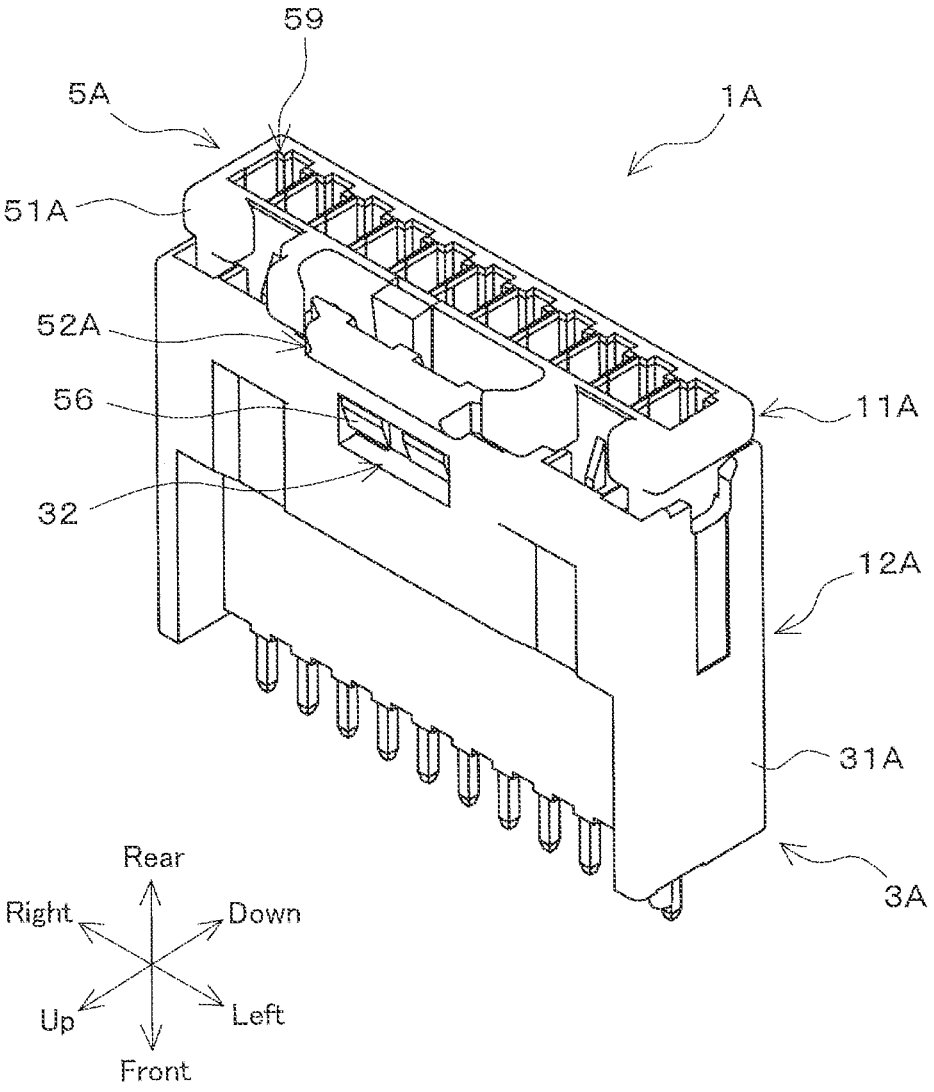
FIG. 2 is a perspective view of an electrical connection device according to an embodiment of the present invention after fitting (fitted state).

FIG. 1 is a perspective view of an electrical connection device 1A according to an embodiment of the present invention before fitting (unfitted state). FIG. 2 is a perspective view of the electrical connection device 1A according to the embodiment of the present invention after fitting (fitted state).

Note that in the figures, for convenience in the description. "rightward" refers to the direction indicated by the arrow denoted by "right", "leftward" refers to the direction indicated by the arrow denoted by "left". "upward" and "upper" refer to the direction indicated by the arrow denoted by "up". "downward" and "lower" refer to the direction indicated by the arrow denoted by "down", "forward" and "front" refer to the direction indicated by the arrow denoted by "front", and "rearward" and "rear" refer to the direction indicated by the arrow denoted by "rear".

Also, hereinafter, "unfitted state" refers to the state in which a pair of connectors have not yet been fitted together, and "fitted state" refers to the state in which pair of connectors have already been fitted together.

Configuration of Electrical Connection Device

As shown in FIG. 1, the electrical connection device 1A includes a pair of connectors, namely a first connector 11A and a second connector 12A. The pair of connectors 11A and 12A can be fitted together. In the electrical connection device 1A, the first connector 11A and the second connector 12A are electrically connected together by being fitted into each other (see FIG. 2).

The electrical connection device 1A of the present embodiment is a so-called locking electrical connection device that includes a lock mechanism for preventing the separation of the first connector 11A from the second connector 12A. Also, the electrical connection device 1A of the present embodiment is a so-called inner lock type of electrical connection device in which a lock arm 52A (described later) of the first connector 11A engages with the second connector 12A from a position inside the body of the second connector 12A (see FIGS. 1 and 2).

The following describes the configurations of the first connector 11A and the second connector 12A of the present embodiment. Note that for convenience in the description, the configuration of the second connector 12A is described first.

Configuration of Second Connector

Figure 3:
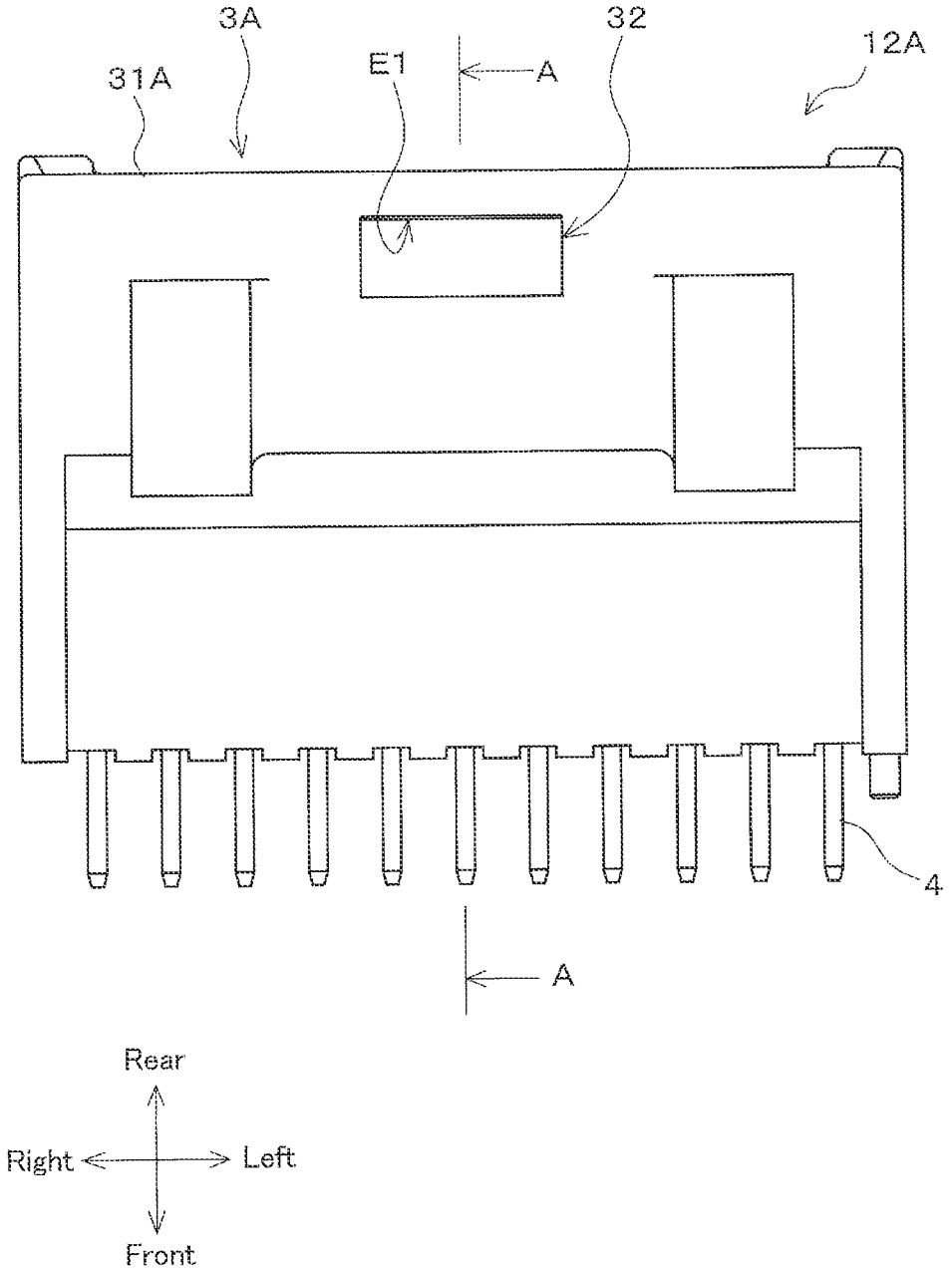
FIG. 3 is a diagram of a second connector according to the first embodiment as viewed from above.
Figure 4A:
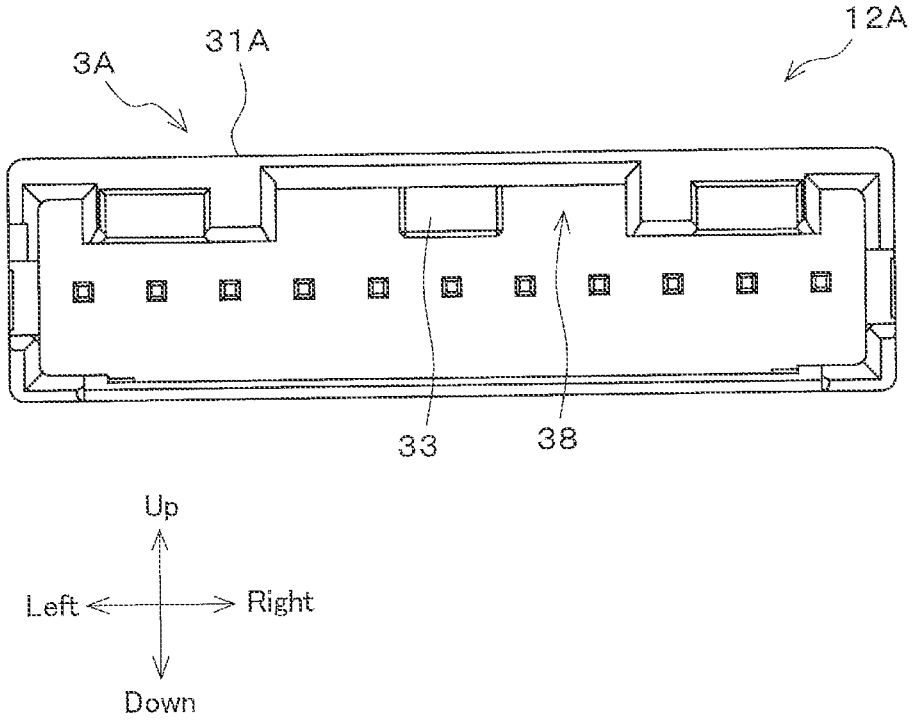
FIG. 4A is a diagram of the second connector according to the first embodiment as viewed from behind.
Figure 4B:
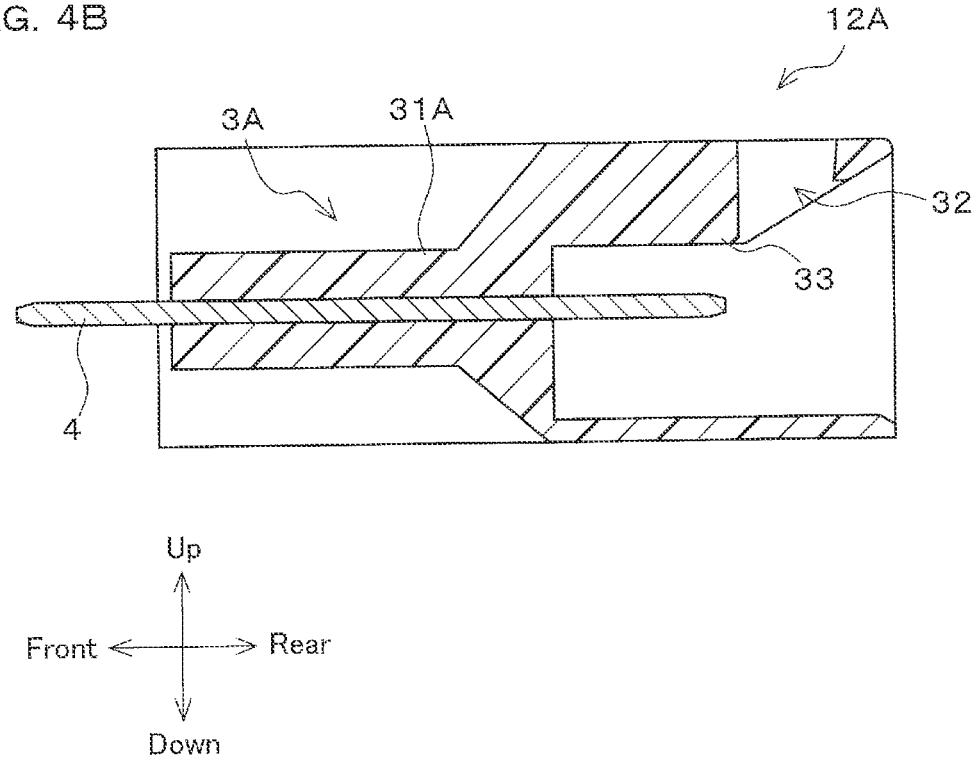
FIG. 4B is a cross-sectional view of the second connector shown in FIG. 3, taken along arrows A-A.

First, the configuration of the second connector 12A will be described with reference to FIGS. 1, 2, 3, 4A and 4B. FIG. 3 shows the second connector 12A from above (top view), and FIG. 4A shows the second connector 12A from behind. Also, FIG. 4B is a cross-sectional view of the second connector 12A shown in FIG. 3, taken along arrows A-A.

The second connector 12A includes a second housing 3A and male contacts 4. Due to the second connector 12A being the partner connector with which the first connector 11A engages, the second connector 12A will also be called the partner connector, for example, and the second housing 3A will also be called the partner housing, for example.

As shown in FIGS. 3 and 4A, the second housing 3A includes a second housing main body portion 31A, a lock receiving portion 32, a rib 33, and the like.

The second housing 3A is made of an insulating resin material. Also, in the present embodiment, the second housing main body portion 31A, the lock receiving portion 32 and the rib 33 are formed as a single body through simultaneous molding.

The second housing main body portion 31A is constituted as the main body portion of the second connector 12A. As shown in FIG. 1, in the present embodiment, the second housing main body portion 31A is approximately plate-shaped.

The lock receiving portion 32 (see FIG. 3) is capable of engaging with the lock arm 52A (described later) of the first connector 11A. Specifically, the lock receiving portion 32 is provided on the inward side of the second housing main body portion 31A In the present embodiment, as shown in FIG. 4B, the lock receiving portion 32 penetrates from the inward upper surface of the second housing main body portion 31A to the outside of the second housing main body portion 31A. When the pair of connectors 11A and 12A are in the fitted state (see FIG. 2), separation of the first connector 11A of the second connector 12A is prevented due to a lock portion 56 (described later) of the lock arm 52A of the first connector 11A engaging with an edge (edge portion) E1 of the lock receiving portion 32 of the second connector 12A.

As shown in FIG. 4A, the second housing 3A includes the rib 33. The rib 33 is provided in order to increase the strength of the second housing main body portion 31A. The rib 33 protrudes downward from the inward upper surface of the second housing main body portion 31A, that is to say is shaped as a protrusion. In the present embodiment, the rib 33 is provided on approximately the central portion of the inward upper surface of the second housing main body portion 31A in the width direction (the left-right direction in FIG. 4A) of the second connector 12A.

Also, in the electrical connection device 1A of the present embodiment, the rib 33 not only functions as a reinforcing portion for increasing the strength of the second housing main body portion 31A, but also functions as an abutting portion that comes into contact with a later-described cantilever portion 53A when the pair of connectors 11A and 12A are fitted together. This will be described in detail later.

The second housing main body portion 31A is also provided with a groove portion 38 (see FIG. 4A) into which the body of the lock arm 52A fits when the pair of connectors 11A and 12A are fitted together.

The second connector 12A of the present embodiment includes multiple male contacts 4 (see FIGS. 1 and 3). The male contacts 4 are held in the second housing main body portion 31A. The male contacts 4 are pin-shaped members made of a conductive metal. When the electrical connection device 1A is used in order to connect connection target members (e.g., a substrate and electrical wires), the male contacts 4 are electrically and mechanically connected to one of the connection target members (e.g., the substrate).

Configuration of First Connector

Figure 5:
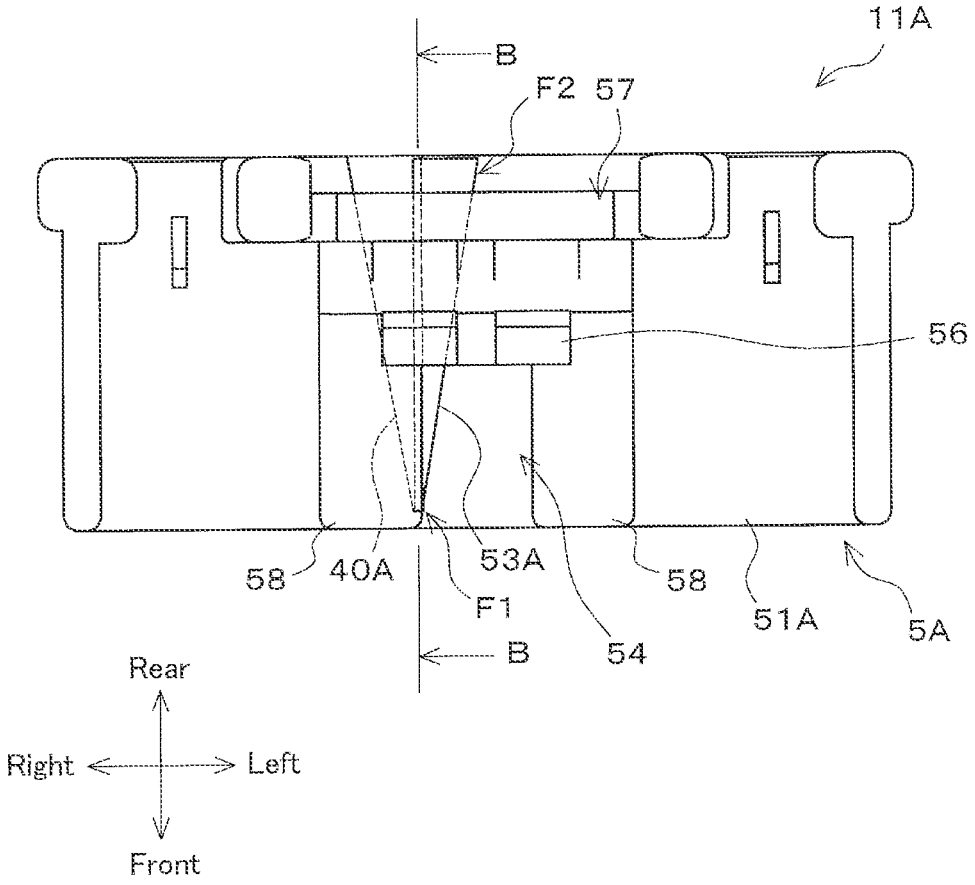
FIG. 5 is a diagram of a first connector according to the first embodiment as viewed from above.
Figure 6A:
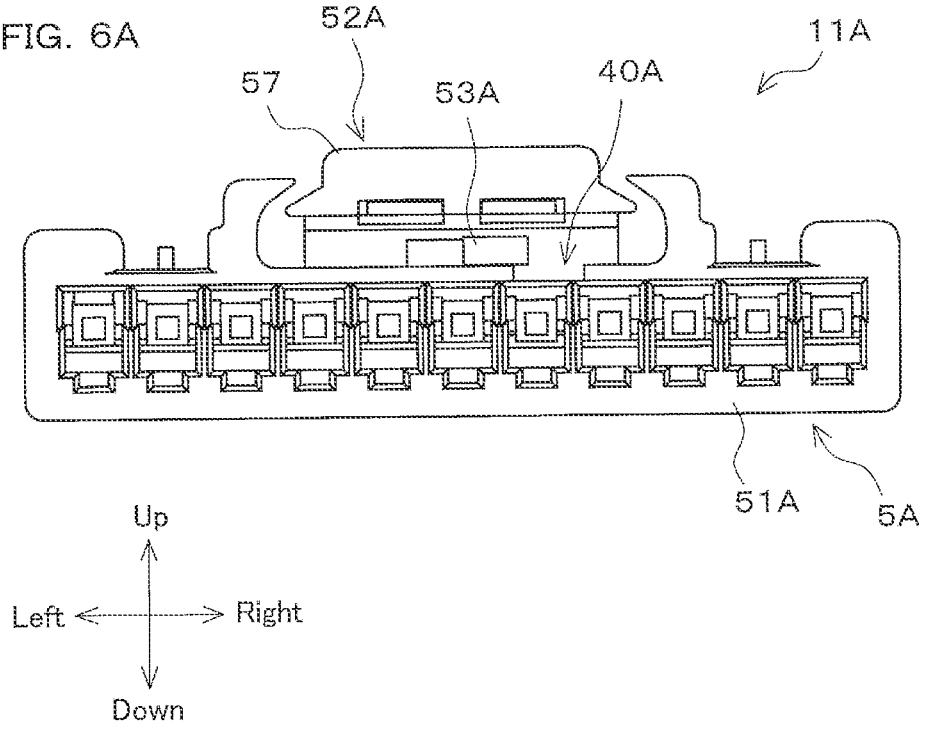
FIG. 6A is a diagram of the first connector according to the first embodiment as viewed from behind.
Figure 6B:
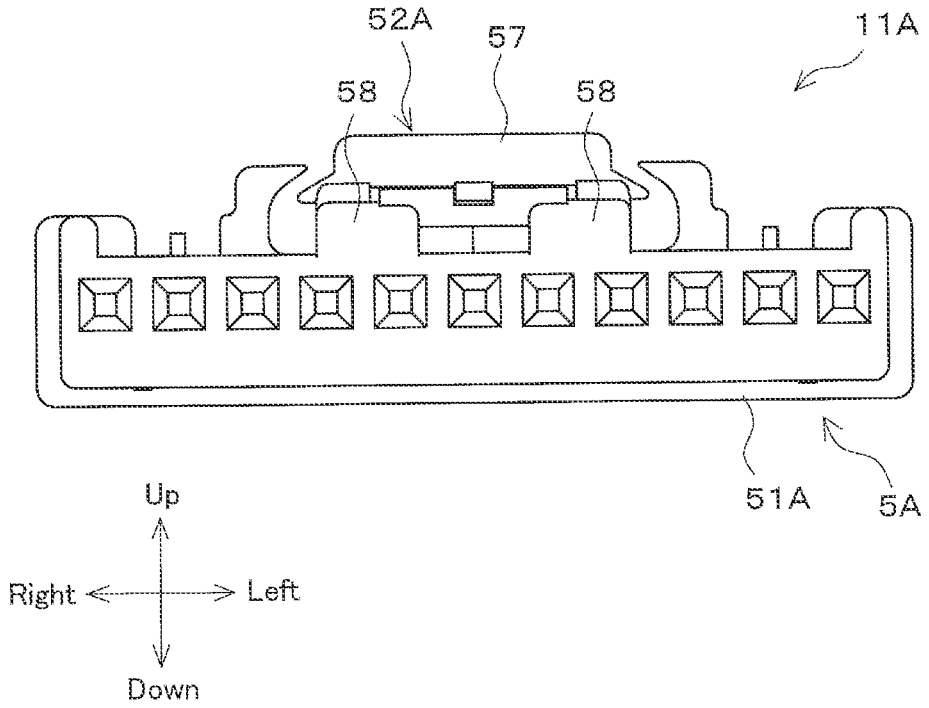
FIG. 6B is a diagram of the first connector according to the first embodiment as viewed from ahead.
Figure 7:
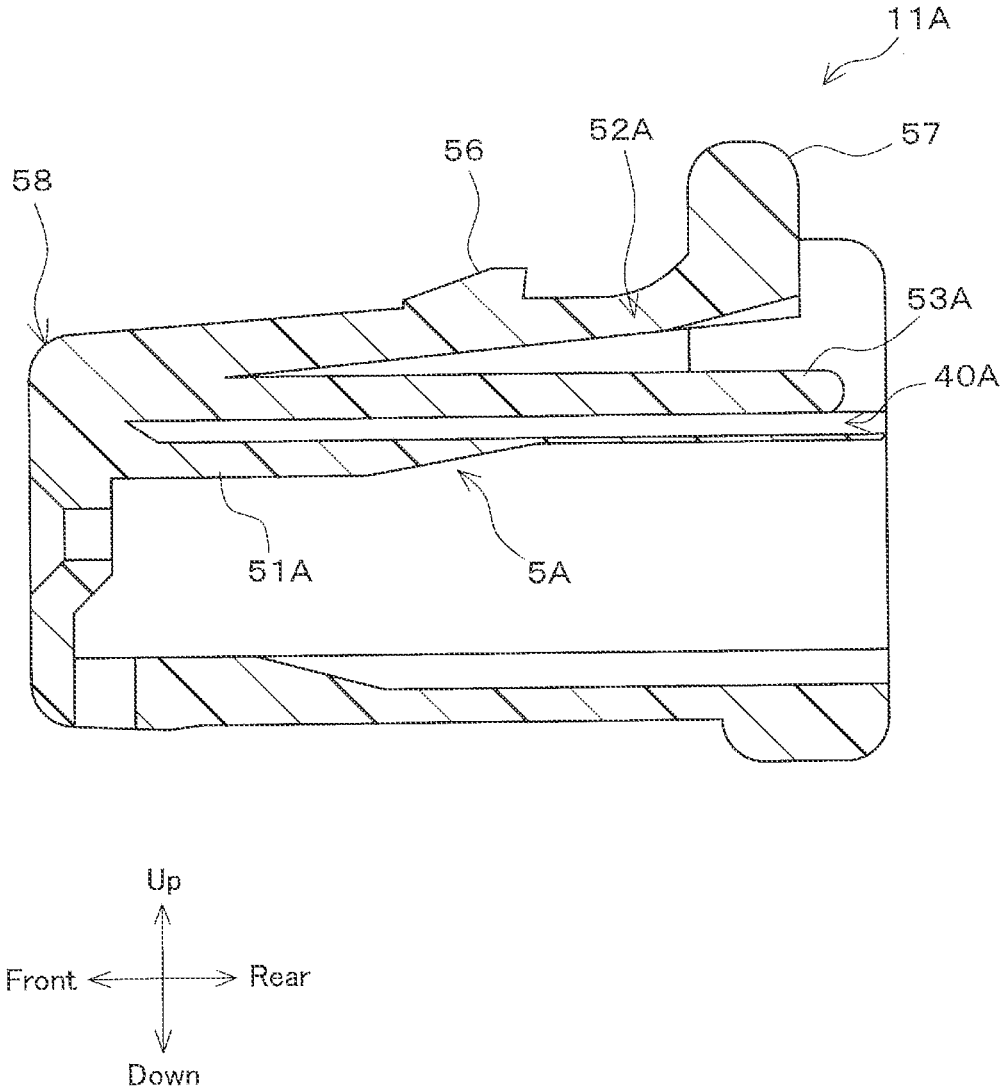
FIG. 7 is a cross-sectional view of the first connector shown in FIG. 5, taken along arrows B-B.

Next, the configuration of the first connector 11A will be described with reference to FIGS. 1, 2, 5, 6A 6B, and 7. FIG. 5 shows the first connector 11A from above (top view). FIG. 6A shows the first connector 11A from behind, and FIG. 6B shows the first connector 11A from ahead. Also, FIG. 7 is a cross-sectional view of the first connector 11A shown in FIG. 5, taken along arrows B-B.

The first connector 11A is a connector that is fitted into and engages with the second connector 12A. The first connector 11A includes a first housing 5A and the like.

The first housing 5A includes a first housing main body portion 51A the lock arm 52A, and the cantilever portion 53A.

The first housing 5A is made of an insulating resin material. Also, in the present embodiment, the first housing main body portion 51A the lock arm 52A, and the cantilever portion 53A are formed as a single body through simultaneous molding.

The first housing main body portion 51A is constituted as the main body portion of the first connector 11A. As shown in FIG. 1, in the present embodiment, the first housing main body portion 51A is approximately plate-shaped.

The lock arm 52A is a portion for preventing the separation of the first connector 11A from the second connector 12A, and is provided on the first housing main body portion 51A so as to be capable of flexing (i.e., capable of elastic deformation).

The lock arm 52A includes lock portions 56, a lock operation portion 57, and support portions 58.

The lock portions 56 are capable of engaging with the lock receiving portion 32 of the second connector 12A. In the present embodiment, as shown in FIG. 7, the lock portions 56 are shaped as protrusions on the upper surface of the body of the lock arm 52A. Also, the lock portions 56 are inclined such that the height thereof increases from the front side toward the rear side. When the pair of connectors 11A and 12A are fitted together, the inclined portions of the lock portions 56 of the first connector 11A come into contact with the inward side of the second housing main body portion 31A of the second connector 12A, and the lock arm 52A thus elastically deforms toward the first housing main body portion 51A.

The lock operation portion 57 is provided to allow unlocking the lock portion 56 when the lock portions 56 are locked by the lock receiving portion 32. For example, when the worker pushes the lock operation portion 57 toward the first housing main body portion 51A (downward), the lock arm 52A becomes elastically displaced toward the first housing main body portion 51A. The lock portions 56 thus become displaced toward the first housing main body portion 51A, and the lock portions 56 become unlocked. When the first connector 11A is pulled out from the second connector 12A in this state, the first connector 11A separates from the second connector 12A.

The support portions 58 (see FIGS. 6B and 7) are portions for supporting the body of the lock arm 52A, and the lock arm 52A is connected to the first housing main body portion 51A via the support portions 58. Specifically, as shown in FIG. 7, the support portions 58 support the base portion of the lock arm 52A at the front end portion of the first housing main body portion 51A. Also, in the first connector 11A of the present embodiment, as shown in FIG. 6B, one support portion 58 is provided for each side of the lock arm 52A in the left-right direction. In other words, two support portions 58 are provided so as to sandwich a rib groove 54 that will be described next.

As shown in FIGS. 1 and 5, a rib groove 54 is provided in the lock arm 52A. The rib groove 54 is formed so as to be capable of fitting together with the rib 33 (see FIG. 4A) of the second connector 12A when the pair of connectors 11A and 12A are fitted together.

Also, the first connector 11A of the present embodiment further includes the cantilever portion 53A that extends in a cantilevered manner from the lock arm 52A at a position between the first housing main body portion 51A and the lock arm 52A (see FIGS. 5 and 7).

In the present embodiment, the cantilever portion 53A is capable of elastic displacement in a horizontal plane that is perpendicular to the flexing direction of the lock arm 52A (up-down direction). Specifically, the cantilever portion 53A is capable of swinging about a fixed end F1 in the horizontal plane perpendicular to the flexing direction.

In the present embodiment, the cantilever portion 53A is provided at the base portion of the body of the lock arm 52A (see FIG. 7). In other words, the fixed end F1 of the cantilever portion 53A is provided on the support portion 58 of the lock arm 52A.

Also, as shown in FIG. 5, in the present embodiment, the cantilever portion 53A is approximately triangular, or more specifically approximately right triangular, in the horizontal plane. Specifically, out of the three vertices of the cantilever portion 53A that is approximately triangular in the horizontal plane, one vertex is provided at the base portion of the lock arm 52A, and the two remaining vertices are provided on the side opposite to the base portion of the lock arm 52A. In other words, the cantilever portion 53A is shaped such that the width thereof increases from the fixed end F1 side toward a free end F2 side of the cantilever portion 53A (from the front side toward the rear side in FIG. 5) in the horizontal plane. Note that the fixed end F1 on the aforementioned one vertex side has a certain width at the base portion of the lock arm 52A and is integrated with the lock arm 52A.

As shown in FIG. 5, the sloped portion of the approximately right triangular cantilever portion 53A (the portion corresponding to the sloped side of the right triangle) protrudes into the rib groove 54. As the pair of connectors 11A and 12A are fitted together, the rib 33 of the second connector 12A comes into contact with the sloped portion of the cantilever portion 53A that protrudes into the rib groove 54.

Also, as shown in FIGS. 5, 6A, and 7, a recession portion 40A capable of housing the cantilever portion 53A is provided in a portion of the first housing main body portion 51A that faces the body of the lock arm 52A (a portion below the lock arm 52A in the aforementioned figures). The recession portion 40A is formed so as to be wider than the cantilever portion 53A.

Note that the recession portion 40A of the present embodiment is not required to be capable of housing the entirety of the cantilever portion 53A with respect to the height direction, and need only be able to house a portion of the cantilever portion 53A in the height direction. Specifically, it is sufficient that the height (depth) of the recession portion 40A of the present embodiment is greater than or equal to the displacement amount (flexing amount) during flexing of the lock arm 52A when the pair of connectors 11A and 12A are fitted together.

Also, as shown in FIG. 1, the first housing 5A of the first connector 11A is provided with multiple contact holding holes 59 for holding female contacts connected to the end of cables (electrical wires). When the pair of connectors 11A and 12A are fitted together the female contacts that were inserted into the contact holding holes 59 of the first connector 11A are electrically and mechanically connected to the male contacts 4 of the second connector 12A. Accordingly, the two connection target members (e.g., a substrate and an electrical wire) are electrically connected to each other.

Operations of Portions when Fitting Pair of Connectors Together

When the pair of connectors 11A and 12A having the above-described configurations are to be fitted together, the above-described elements operate as described below.

Figure 8A:
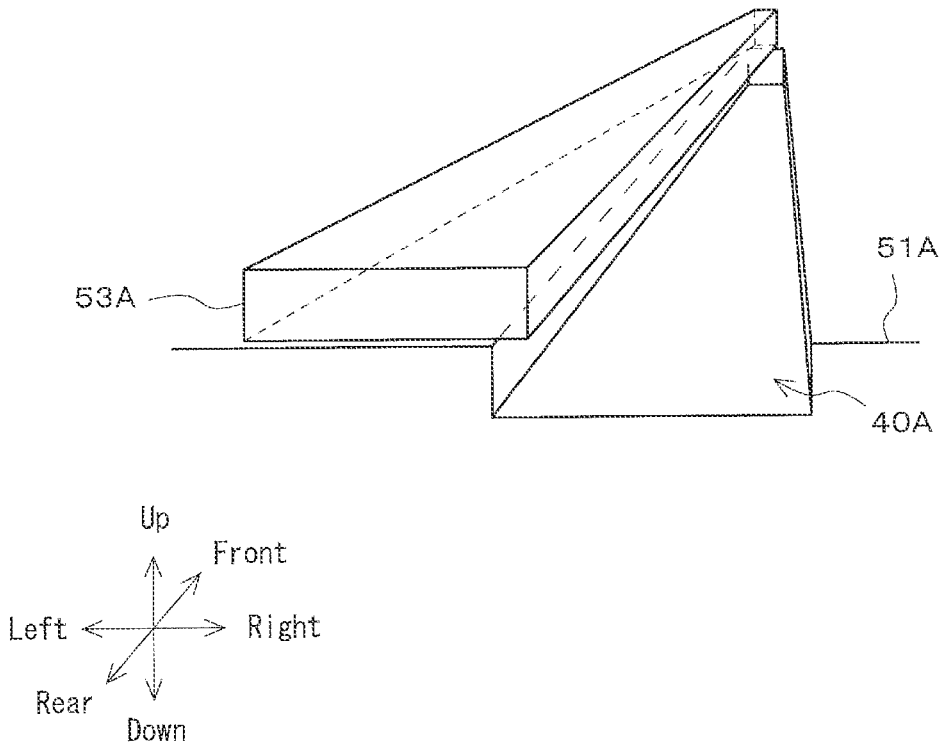
FIGS. 8A and 8B are conceptual diagrams showing operations of a cantilever portion in a connector fitting operation, where
Figure 8B:
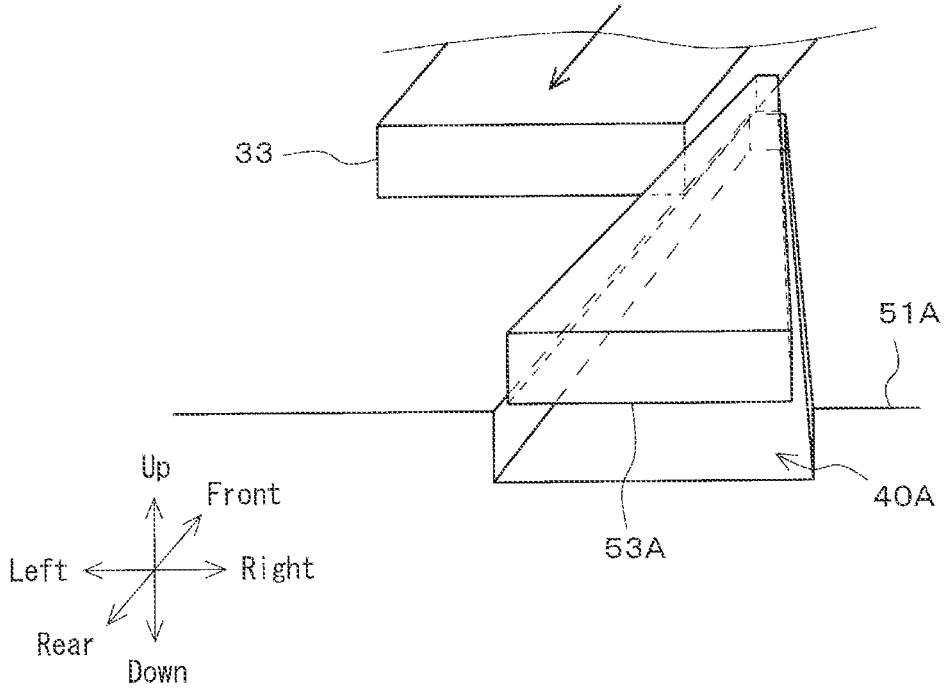
Figure 9:
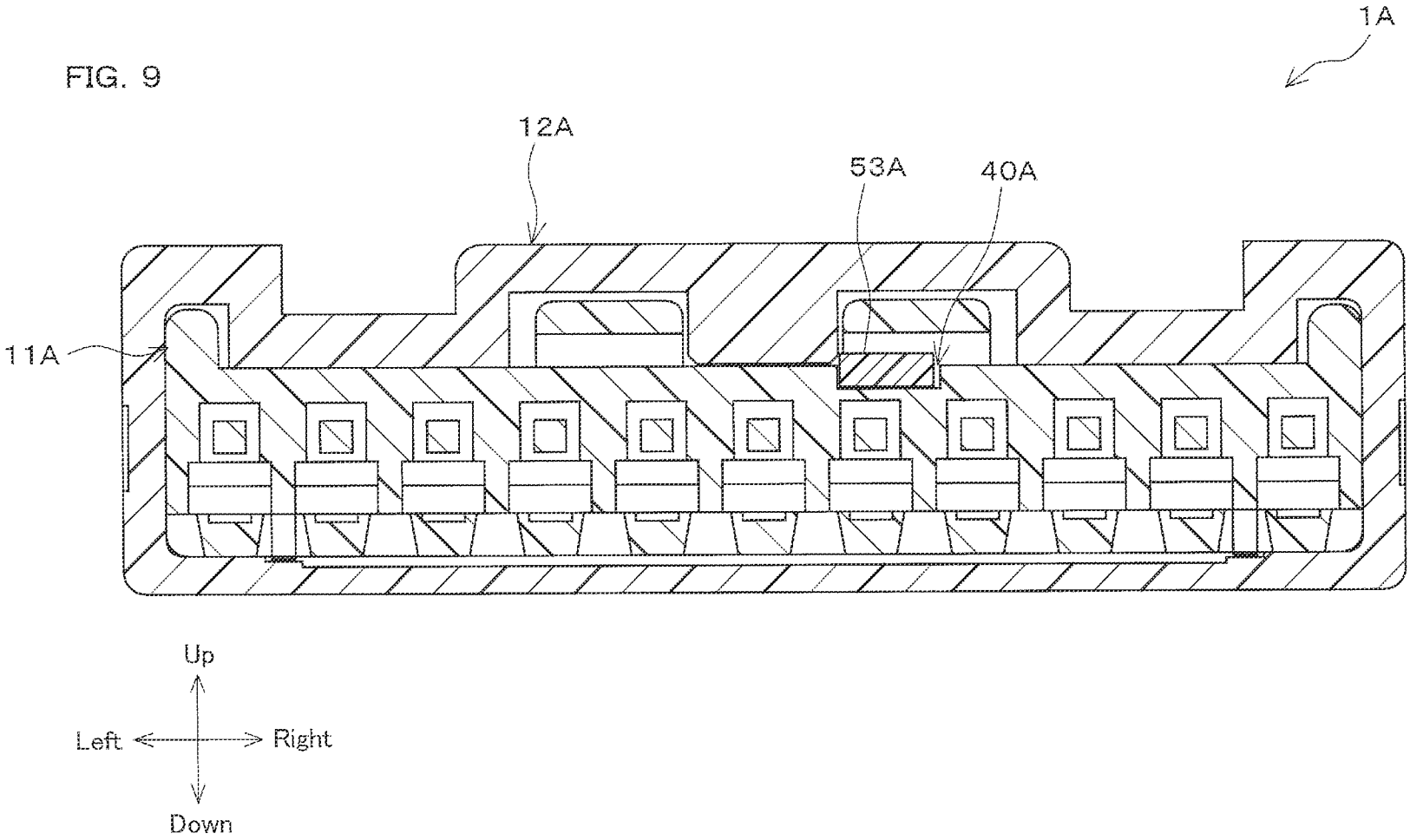
FIG. 9 is a cross-sectional view of the pair of connectors from behind, and shows the state in which the cantilever portion is housed in a recession portion.

FIGS. 8A and 8B are conceptual diagrams showing operations of the cantilever portion 53A when the pair of connectors 11A and 12A are fitted together. FIG. 8A is a conceptual diagram showing the cantilever portion 53A in the unfitted state, and FIG. 8B is a conceptual diagram showing the cantilever portion 53A during the fitting operation. Note that although not shown in FIGS. 8A and 8B, the body of the lock arm 52A is actually located above the cantilever portion 53A. Also, FIG. 9 is a cross-sectional view showing the state in which the cantilever portion 53A is housed in the recession portion 40A (a cross-sectional view of the pair of connectors 11A and 12A from behind).

First, when the pair of connectors 11A and 12A are in the unfitted state, as shown in FIG. 6A, the cantilever portion 53A is located between the first housing main body portion 51A of the first connector 11A and the body of the lock arm 52A so as to be capable of supporting the body of the lock arm 52A In other words, the cantilever portion 53A is arranged at a position capable of preventing the lock arm 52A from flexing toward the first housing main body portion 51A.

Specifically when the pair of connectors 11A and 12A are in the unfitted state, as shown in FIG. 8A, there is almost no gap between the lower surface of the cantilever portion 53A and the upper surface of the first housing main body portion 51A. For this reason, if pushing force is applied to the lock arm 52A of the first connector 11A from above in this state, the lock arm 52A is supported by the cantilever portion 53A, and the lock arm 52A is thus prevented from flexing toward the first housing main body portion 51A.

The worker then performs an operation for fitting the first connector 11A, which is in the above-described state, into the second connector 12A (this operation will also called a fitting operation).

As described above, the free-end-side portion of the cantilever portion 53A (more specifically the sloped portion of the approximately right triangular cantilever portion 53A) protrudes into the rib groove 54 (see FIG. 5), and when the first connector 11A is inserted into the second connector 12A, the rib 33, which functions as an abutting portion that abuts against the cantilever portion 53A comes into contact with the free-end-side portion of the cantilever portion 53A.

When the rib 33 moves further toward the first connector 11A along the rib groove 54, the cantilever portion 53A is subjected to pushing force acting in the swing direction. As a result, as shown in FIG. 8B, the cantilever portion 53A becomes elastically displaced to a position above the recession portion 40A of the first housing main body portion 51A in the horizontal plane perpendicular to the flexing direction of the lock arm 52A In other words, the cantilever portion 53A swings about its fixed end F1 to a position that allows the lock arm 52A to flex toward the first housing main body portion 51A.

Thereafter, the inclined portions of the protrusion-shaped lock portions 56 (see FIG. 1) provided on the lock arm 52A come into contact with the inward side of the second housing main body portion 31A of the second connector 12A, and the lock arm 52A is subjected to pushing force acting toward the first housing main body portion 51A (downward). Due to the existence of the recession portion 40A (see FIG. 8B) below the cantilever portion 53A, the lock arm 52A is allowed to flex toward the first housing main body portion 51A, and the lock arm 52A thus flexes toward the first housing main body portion 51A. At this time, when the lock arm 52A flexes, the cantilever portion 53A becomes displaced toward the recession portion 40A and housed in the recession portion 40A (see FIG. 9).

When the lock portions 56 of the lock arm 52A are then further pressed to a position below the lock receiving portion 32, the lock arm 52A becomes displaced upward due to the elastic force of the lock arm 52A, and the lock portions 56 are fitted into the lock receiving portion 32. Accordingly the lock portions 56 of the lock arm 52A engage with the lock receiving portion 32, and the first connector 11A is prevented from separating from the second connector 12A.

Note that as the lock arm 52A becomes displaced upward due to the elastic force thereof the cantilever portion 53A also becomes displaced to a position above the recession portion 40A. However, because the rib 33 has been inserted into the rib groove 54, the cantilever portion 53A remains at a position above the recession portion 40A rather than returning to a position capable of supporting the lock arm 52A (so-called original position).

The above-described operations are performed when fitting the pair of connectors 11A and 12A together.

Also, when unlocking the pair of connectors 11A and 12A the worker performs a pressing operation for pressing the lock operation portion 57 (see FIG. 1) toward the first housing main body portion 51A, and then performs a withdrawal operation for withdrawing the first connector 11A from the second connector 12A while continuing the pressing operation.

Because the cantilever portion 53A is located at a position above the recession portion 40A of the first housing main body portion 51A during the pressing operation, when the lock operation portion 57 is pressed toward the first housing main body portion 51A the lock arm 52A flexes toward the first housing main body portion 51A.

Thereafter, when the withdrawal operation is performed to withdraw the first connector 11A from the second connector 12A the rib 33 moves rearward along the rib groove 54. Accordingly, the cantilever portion 53A returns to the original position (position capable of supporting the lock arm 52A (see FIG. 6A)) due to the elastic force thereof.

ACTIONS AND EFFECTS OF PRESENT EMBODIMENT

As described above, in the electrical connection device 1A of the present embodiment, when the pair of connectors 11A and 12A are in the unfitted state, the cantilever portion 53A is located between the first housing main body portion 51A of the first connector 11A and the lock arm 52A so as to be capable of supporting the lock arm 52A (see FIG. 6A). For this reason, even if excessive pushing force acting toward the first housing main body portion 51A is applied to the lock arm 52A while the pair of connectors 11A and 12A are transported in the unfitted state for example, the cantilever portion 53A prevents the lock arm 52A from excessively flexing toward the first housing main body portion 51A. Accordingly it is possible to suppress the loss of strength of the lock arm 52A in the pair of connectors 11A and 12A in the unfitted state.

Also, according to the electrical connection device 1A of the present embodiment, when the pair of connectors 11A and 12A are fitted together, the cantilever portion 53A elastically deforms due to the rib 33 (abutting portion) coming into contact with the cantilever portion 53A, and flexing of the lock arm 52A is allowed. Then, due to elastic force (i.e., automatically), the lock arm 52A engages with the lock receiving portion 32 of the second connector 12A. For this reason, the worker can fit the pair of connectors 11A and 12A together with a single operation (i.e., in a single action). Specifically the worker does not need to perform two operations as with the invention disclosed in JP 2014-207100 described above in which the worker performs an operation for inserting the one connector into the other connector and then performs an operation for canceling the restriction of the lock arm by the semi lock portion, for example. Accordingly, it is possible to prevent a reduction in operability when fitting the pair of connectors 11A and 12A together, that is to say, it is possible to facilitate the operation of fitting the pair of connectors 11A and 12A together.

Furthermore, when the first connector 11A is to be withdrawn from the second connector 12A, the worker need only perform two operations, namely a pressing operation for pressing the lock operation portion 57 toward the first housing main body portion 51A and a withdrawal operation for withdrawing the first connector 11A from the second connector 12A.

As described above, according to the electrical connection device 1A of the present embodiment, it is possible to prevent a loss of strength of the lock arm 52A in the pair of connectors 11A and 12A in the unfitted state, and it is also possible to facilitate the operation of fitting the pair of connectors 11A and 12A together.

Also, with the electrical connection device 1A of the present embodiment, the recession portion 40A which can house the cantilever portion 53A, is provided in a portion of the first housing main body portion 51A that faces the lock arm 52A (see FIG. 6A). For this reason, when the pair of connectors 11A and 12A are in the unfitted state, the cantilever portion 53A is located between the first housing main body portion 51A and the lock arm 52A (see FIG. 6A), and when the pair of connectors 11A and 12A are fitted together, the cantilever portion 53A is housed in the recession portion 40A (see FIG. 9). In other words, in the operation of fitting the pair of connectors 11A and 12A together, the cantilever portion 53A is not located at a position protruding from the portion that faces the lock arm 52A. Accordingly the cantilever portion 53A is compactly provided in the first connector 11A in a space-efficient manner, and it is possible to achieve a reduction in the size of the first connector 11A that includes the cantilever portion 53A.

Also, in the electrical connection device 1A of the present embodiment, the cantilever portion 53A is provided on the lock arm 52A (see FIG. 7). For this reason, the cantilever portion 53A can become displaced in the flexing direction of the lock arm 52A without the cantilever portion 53A being provided with a separate configuration for flexing in that flexing direction. Accordingly the displacement of the cantilever portion 53A in the flexing direction of the lock arm 52A can be realized with a simple configuration.

Also, in the electrical connection device 1A of the present embodiment, the cantilever portion 53A is provided at the base portion of the lock arm 52A (see FIG. 7). For this reason, it is possible to maximize the distance between the fixed end and the free end of the cantilever portion 53A. As a result, when the rib 33 (the abutting portion equivalent to the cantilever portion 53A) comes into contact with the free-end-side portion of the cantilever portion 53A the cantilever portion 53A can easily undergo elastic deformation, and the worker can fit the pair of connectors 11A and 12A together with relatively little force.

Also, in the electrical connection device 1A of the present embodiment, the rib 33 (see FIG. 4A), which is a reinforcing portion for increasing the strength of the second housing main body portion 31A of the second connector 12A, functions as the abutting portion that comes into contact with the cantilever portion 53A, and the rib groove 54 is provided in the lock arm 52A In other words, elastic displacement of the cantilever portion 53A is realized with use of the rib groove 54 and the rib 33 provided in order to increase the strength of the second housing main body portion 31A. Accordingly there is no need to provide a new configuration for realizing elastic displacement of the cantilever portion 53A (a configuration separate from the rib 33 and the rib groove 54), thus making it possible to suppress an increase in cost when manufacturing the pair of connectors 11A and 12A.

Also, in the electrical connection device 1A of the present embodiment, the cantilever portion 53A is shaped such that the width thereof increases from the fixed end F1 side toward a free end F2 side of the cantilever portion 53A (see FIG. 5). For this reason, the first connector 11A can be molded through simultaneous molding performed using a two-piece mold that includes only an upper mold and a lower mold. In other words, there is no need for a slide core to be combined with the upper mold and the lower mold when forming a cavity for molding of the first connector 11A in the mold. Accordingly, it is possible to suppress an increase in the cost of the mold for molding the first connector 11A.

Variation of First Embodiment

Although the cantilever portion 53A is provided on the lock arm 52A (see FIG. 7) in the first embodiment, there is no limitation to this. For example, the cantilever portion 53A may be provided on the first housing main body portion 51A In this case, the cantilever portion 53A may be provided with a configuration for flexing in the flexing direction of the lock arm 52A.

Second Embodiment

The second embodiment is a variation of the first embodiment. The following description focuses on differences from the first embodiment.

In the first embodiment, the recession portion 40A for housing the cantilever portion 53A is provided in the first connector 11A (see FIG. 9).

In contrast, in the second embodiment, a recession portion 40B for housing a cantilever portion 53B is provided in a second connector 12B (see FIG. 15).

Figure 10:
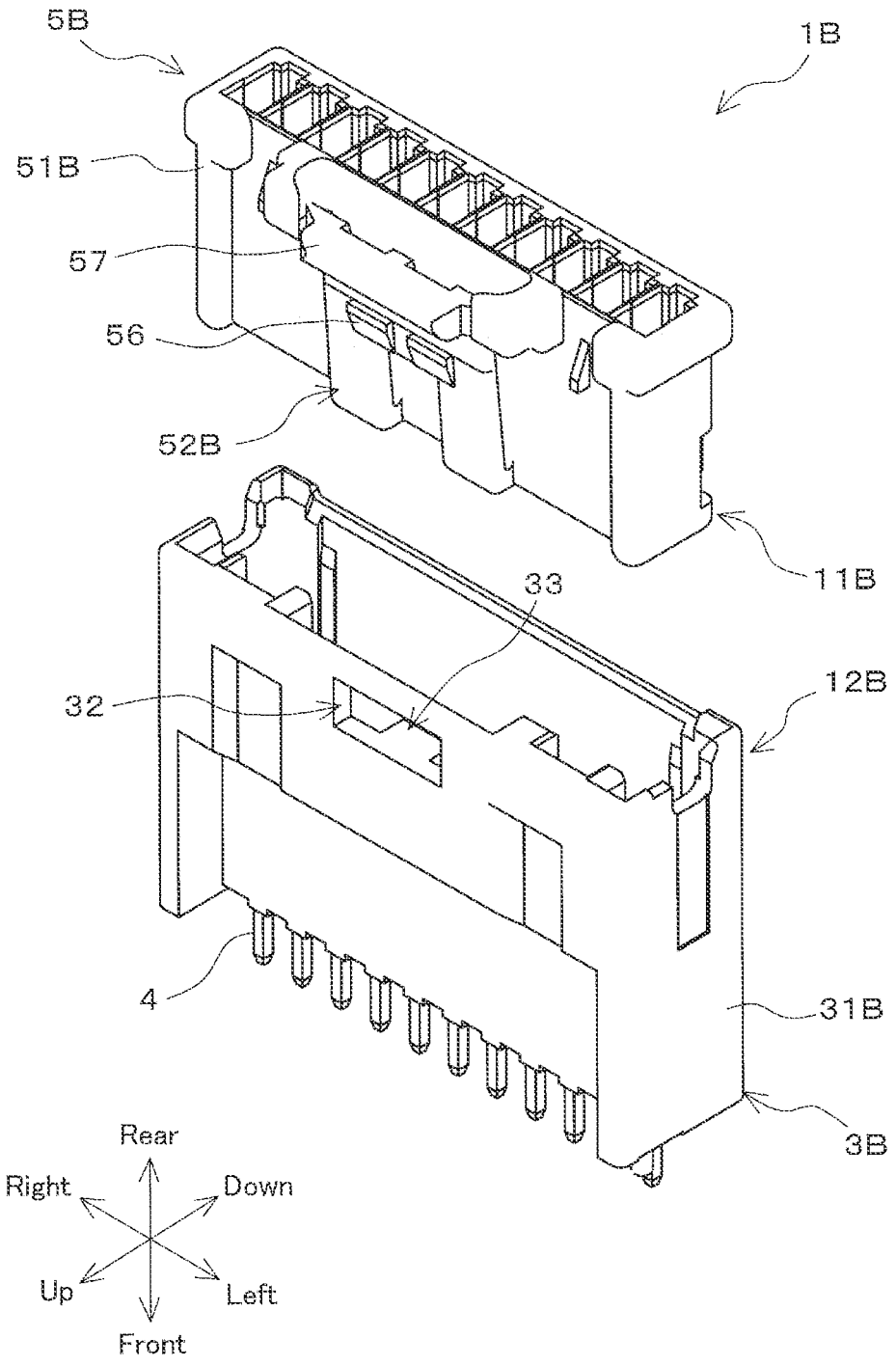
FIG. 10 is a perspective view of an electrical connection device according to a second embodiment of the present invention before fitting (unfitted state).
Figure 11:
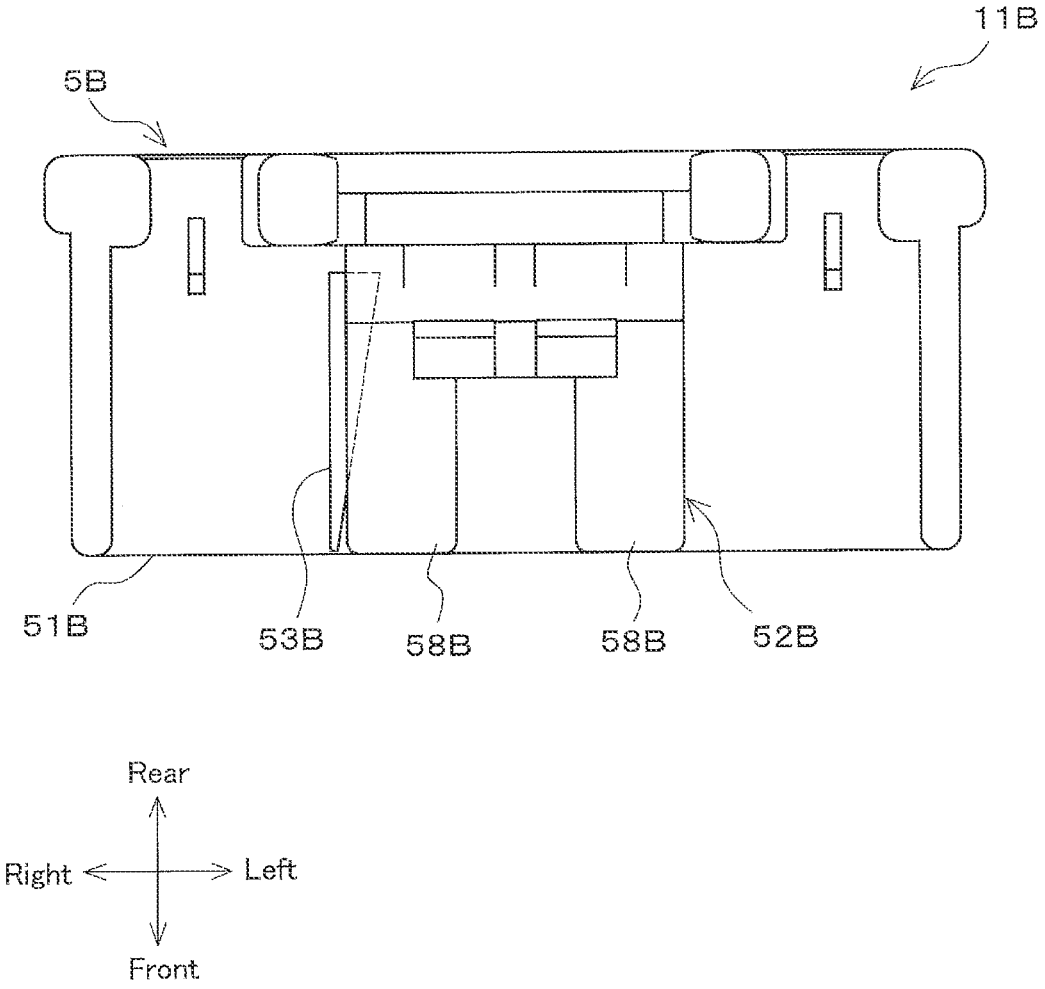
FIG. 11 is a diagram of a first connector according to the second embodiment as viewed from above.
Figure 12A:
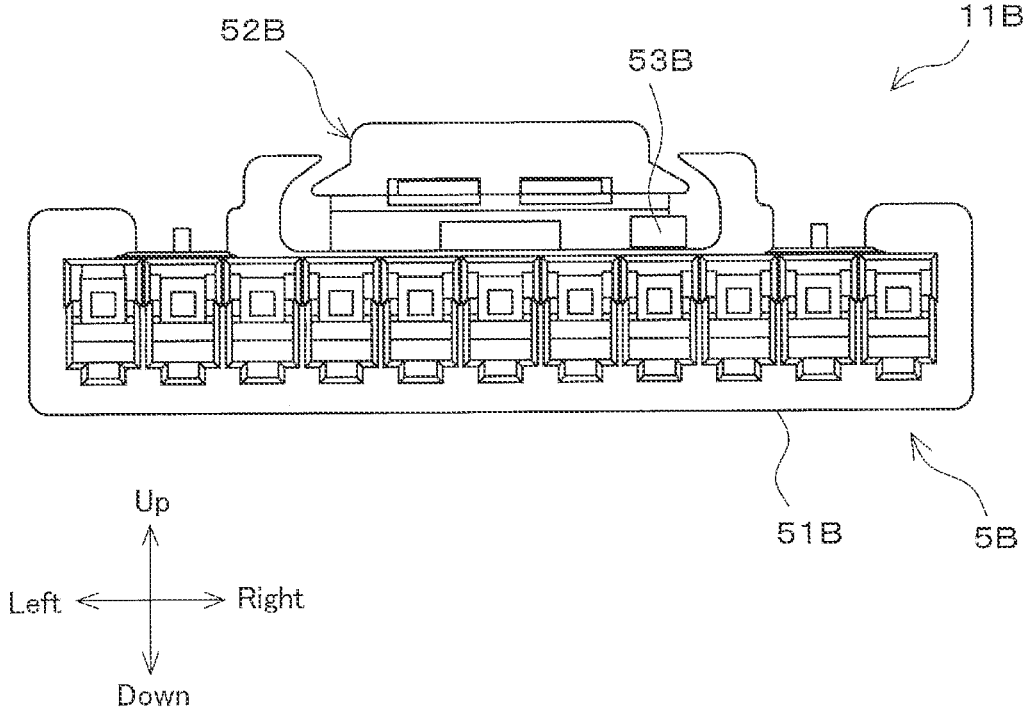
FIG. 12A is a diagram of the first connector according to the second embodiment as viewed from behind, and FIG.
Figure 12B:
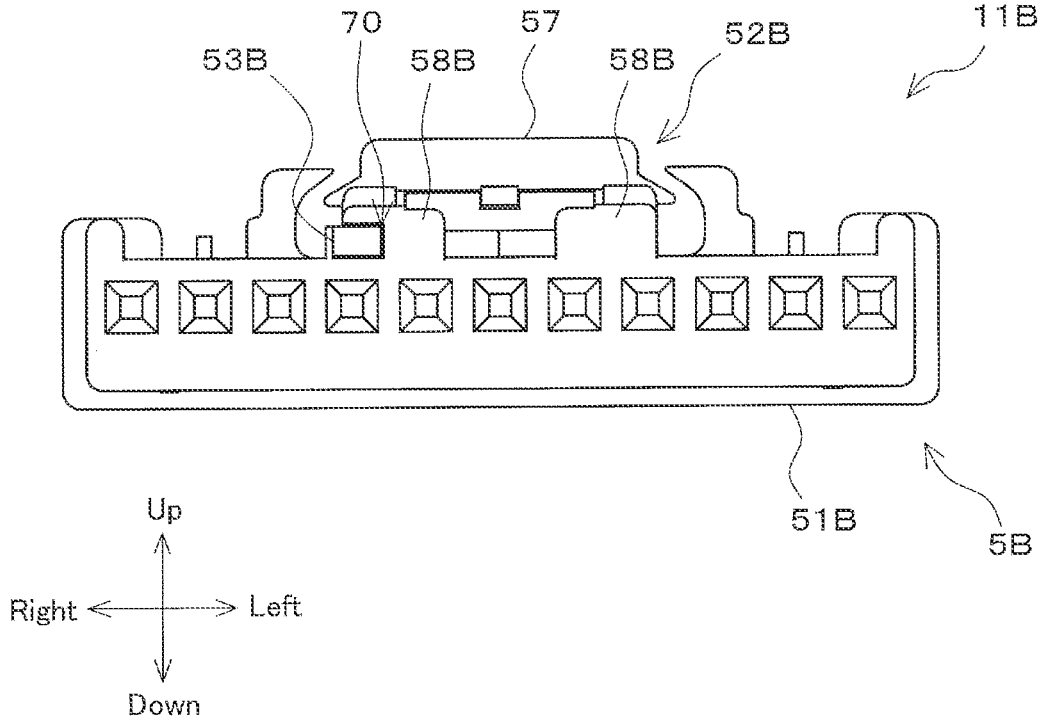

FIG. 10 is a perspective view of an electrical connection device 1B according to the second embodiment before fitting (unfitted state). FIG. 11 is a diagram of a first connector 11B according to the second embodiment as viewed from above. FIG. 12A is a diagram of the first connector 11B according to the second embodiment as viewed from behind, and FIG. 12B is a diagram of the first connector 11B according to the second embodiment as viewed from ahead. FIG. 13 is a diagram of the second connector 12B according to the second embodiment as viewed from above, and FIG. 14 is a diagram of the second connector 12B according to the second embodiment as viewed from behind.

The following describes the electrical connection device 1B of the second embodiment with reference to the aforementioned figures. Note that constituent elements of the electrical connection device 1B of the second embodiment that are not described below have configurations similar to those of corresponding constituent elements of the electrical connection device 1A of the first embodiment, and such constituent elements are not described below.

The first connector 11B of the second embodiment has the cantilever portion 53B that extends in a cantilevered manner from the first housing main body portion 51B (see FIG. 11).

When the pair of connectors 11B and 12B are in the unfitted state, as shown in FIGS. 11 and 12A, the free-end-side portion of the cantilever portion 53B (specifically, a portion of the sloped portion of the approximately right triangular cantilever portion 53B in the horizontal plane) is located between the first housing main body portion 51B and the lock arm 52B.

Note that as shown in FIG. 12B, a support portion 58B of the lock arm 52B (specifically, out of the two support portions 58B, the support portion 58B on the cantilever portion 53B side) of the second embodiment is provided with a cutout portion 70, which is a rectangular cutout that extends from the other end side of the support portion 58B (the right end side in FIG. 12B) toward the central portion. Accordingly, there is no need for a slide core to be combined with the upper mold and the lower mold when forming a cavity for molding of the first connector 11B in the mold, and it is possible to suppress an increase in the cost of the mold for molding the first connector 11B.

Also, as shown in FIGS. 13 and 14, a second housing main body portion 31B of the second connector 12B has a recession portion 40B, which is capable of housing the cantilever portion 53B, in a groove portion 38 into which the body of the lock arm 52B can be fitted. The recession portion 40B is formed such that the height thereof is higher than the height of the cantilever portion 53B.

Also, separately from the rib 33, the second housing main body portion 31B is provided with an abutting portion 35 that comes into contact with the cantilever portion 53B when the pair of connectors 11B and 12B are fitted together. The abutting portion 35 is provided in the gap between a wall portion (specifically the right-end wall portion) of the groove portion 38 provided in the second housing main body portion 31B and the movement path of the lock arm 52B when the pair of connectors 11B and 12B are fitted together.

Operations of Portions when Fitting Pair of Connectors of Second Embodiment Together The above-described constituent elements operate as described below when the pair of connectors 11B and 12B of the second embodiment are fitted together.

First, when the pair of connectors 11B and 12B are in the unfitted state, as shown in FIG. 12A the cantilever portion 53B is located between the first housing main body portion 51B of the first connector 11B and the lock arm 52B so as to be capable of supporting the lock arm 52B. Accordingly, even if excessive pushing force acting toward the first housing main body portion 51B is applied to the lock arm 52B of the first connector 11B, the lock arm 52B is supported by the cantilever portion 53B, and the lock arm 52B is prevented from flexing toward the first housing main body portion 51B.

Also, when the first connector 11B is inserted into the second connector 12B, the abutting portion 35 of the second connector 12B comes into contact with the free-end-side portion of the cantilever portion 53B of the first connector 11B (see FIG. 11), and rearward pushing force is applied to the cantilever portion 53B. Accordingly, the cantilever portion 53B undergoes elastic displacement rightward (toward the recession portion 40B) in the horizontal plane and becomes housed in the recession portion 40B provided in the second connector 12B as shown in FIG. 15. In other words, the cantilever portion 53B retracts to a position that allows the lock arm 52B to flex toward the first housing main body portion 51B.

Thereafter, when the protruding lock portions 56 of the lock arm 52B (see FIG. 10) come into contact with the inward side of the second housing main body portion 31B of the second connector 12B, the lock arm 52B flexes toward the first housing main body portion 51B (i.e., downward). When the lock portions 56 of the lock arm 52B are then further pressed to a position below the lock receiving portion 32, the lock arm 52B becomes displaced upward due to the elastic force of the lock arm 52B, and the lock portions 56 are fitted into the lock receiving portion 32. The first connector 11B and the second connector 12B thus engage with each other.

As described above, in the electrical connection device 1B of the second embodiment, the recession portion 40B, which is capable of housing the cantilever portion 53B, is provided in the second connector 12B (see FIGS. 13 and 14). Also, the cantilever portion 53B becomes housed in the recession portion 40B (see FIG. 15) due to becoming elastically displaced to a position that allows the lock arm 52B to flex toward the first housing main body portion 51B. In this electrical connection device 1B, the cantilever portion 53B need only be shaped so as to be capable of undergoing elastic displacement to a position that allows the lock arm 52B to flex toward the first housing main body portion 51B, and the cantilever portion 53B can be designed with a high degree of freedom.

Also, portions of the electrical connection device 1B of the second embodiment that are the same as those of the electrical connection device 1A of the first embodiment can obtain effects similar to the effects described in the first embodiment.

Variations

Although embodiments of the present invention have been described thus far, the present invention is not limited to the above-described embodiments, and various modifications can be made within the scope recited in the claims. In other words, the present invention is not limited to the above embodiments, and all modifications, applications, and equivalents thereof that fall within the claims for which modifications and applications would become naturally apparent by reading and understanding the present specification, are intended to be embraced in the claims of the invention. For example, variations such as the following may be carried out.

(1) Although a so-called inner lock type of electrical connection device is illustrated in the above embodiments, there is no limitation to this. For example, the idea of the present invention can also be applied to a so-called outer lock type of electrical connection device.

FIG. 16 is a perspective view of an electrical connection device 1C according to this variation before fitting (unfitted state). Also, FIG. 17A is a diagram of the first connector 11C of this variation as viewed from behind, and FIG. 17B is a cross-sectional view of the first connector 11C shown in FIG. 17A, taken along arrows C-C. Also, FIGS. 18 and 19 are conceptual diagrams of operations of a cantilever portion 53C when a pair of connectors 11C and 12C of this variation are fitted together.

As shown in FIG. 16, the electrical connection device 1C of this variation is a so-called outer lock type of electrical connection device in which a lock arm 52C of the first connector 11C engages with the second connector 12C from outside the body of the second connector 12C. In the outer lock type of electrical connection device 1C, contacts 4 of the second connector 12C are inserted into contact insertion holes (not shown) of the first connector 11C, and the second connector 12C is then fitted together with the first connector 11C while moving along guide portions 61 of the first connector 11C.

Note that constituent elements of the electrical connection device 1C of this variation that are not described below have configurations similar to those of corresponding constituent elements of the electrical connection device 1A of the first embodiment, and such constituent elements are not described below.

The lock arm 52C of the first connector 11C is provided with a cantilever portion 53C at a position between the body of the lock arm 52C and a first housing main body portion 51C (see FIGS. 17A and 17B).

Also, in the first connector 11C, a recession portion 40C that can house the cantilever portion 53C is provided in a portion of the first housing main body portion 51C that faces the body of the lock arm 52C.

Furthermore, the second connector 12C of this variation is provided with an abutting portion 60 (see FIG. 16) for coming into contact with the cantilever portion 53C. Here, as shown in FIG. 16, the abutting portion 60 is provided on a second housing main body portion 31C of the second connector 12C, and is shaped as a rib that extends rearward from a lock receiving portion 32C.

When the pair of connectors 11C and 12C having the above-described configurations are to be fitted together, the above-described elements operate as described below.

When the pair of connectors 11C and 12C are in the unfitted state, the cantilever portion 53C is located between the first housing main body portion 51C and the lock arm 52C of the first connector 11C so as to be capable of supporting the lock arm 52C (see FIG. 17A).

Then, when the contacts 4 of the second connector 12C are inserted into the contact insertion holes (not shown) of the first connector 11C, the rib-shaped abutting portion 60 of the second connector 12C comes into contact with the sloped portion of the cantilever portion 53C of the first connector 11C, and the cantilever portion 53C becomes elastically displaced to a position above the recession portion 40C of the first housing main body portion 51C (see FIG. 19).

Thereafter, the lock arm 52C is allowed to flex toward the first housing main body portion 51C, and the lock arm 52C flexes toward the first housing main body portion 51C. At this time, when the lock arm 52C flexes, the cantilever portion 53C becomes displaced toward the recession portion 40C and housed in the recession portion 40C. A lock portion 56C of the lock arm 52C then engages with the lock receiving portion 32C of the second connector 12C, and the pair of connectors 11C and 12C enter the fitted state.

Note that although the cantilever portion 53C is provided on the lock arm 52C in the above variation, there is no limitation to this, and the cantilever portion 53C may be provided on the first housing main body portion 51C. In this case, it is sufficient that the rib-shaped abutting portion 60 is provided on the contact 4 side of the second housing main body portion 31C, for example.

As described above, the idea of the present invention can also be applied to a so-called outer lock type of electrical connection device.

INDUSTRIAL APPLICABILITY

The present invention is widely applicable to an electrical connection device that includes a pair of connectors that can be fitted to each other.

What is claimed is:

1. An electrical connection device comprising:

a first connector that is one of a pair of connectors that can be fitted together; and a second connector that is another one of the pair of connectors, wherein the first connector includes a housing main body portion, a lock arm provided on the housing main body portion so as to be capable of flexing, and a cantilever portion that extends from the housing main body portion or the lock arm in a cantilevered manner and is capable of elastic displacement, the second connector includes a lock receiving portion configured to engage with the lock arm, and an abutting portion configured to come into contact with the cantilever portion when the pair of connectors are fitted together, when the pair of connectors are in an unfitted state, the cantilever portion is located between the housing main body portion and the lock arm so as to be capable of supporting the lock arm, and due to the abutting portion coming into contact with the cantilever portion when the pair of connectors are fitted together the cantilever portion becomes elastically displaced to a position that allows the lock arm to flex toward the housing main body portion.

2. The electrical connection device according to claim 1, wherein the housing main body portion includes a recession portion that is provided in a portion that faces the lock arm and configured to house the cantilever portion, and the cantilever portion is configured to undergo elastic displacement to the position that allows the lock arm to flex toward the housing main body portion, and is configured to thereafter become displaced toward the housing main body portion and housed in the recession portion when the lock arm flexes toward the housing main body portion.

3. The electrical connection device according to claim 2, wherein the cantilever portion is provided on the lock arm.

4. The electrical connection device according to claim 3, wherein the cantilever portion is provided on a base portion of the lock arm.

5. The electrical connection device according to claim 2, wherein a rib provided on the second connector also functions as the abutting portion, the lock arm is provided with a rib groove, and due to the rib being inserted into the rib groove when the pair of connectors are fitted together, the rib serving as the abutting portion comes into contact with the cantilever portion, and the cantilever portion becomes elastically displaced to the position that allows the lock arm to flex toward the housing main body portion.

6. The electrical connection device according to claim 2, wherein the cantilever portion is shaped such that a width of the cantilever portion increases from a fixed end side of the cantilever portion toward a free end side of the cantilever portion.

7. The electrical connection device according to claim 1, wherein the cantilever portion is provided on the housing main body portion, the second connector is provided with a recession portion configured to house the cantilever portion, and the cantilever portion is configured to be housed in the recession portion due to undergoing elastic displacement to the position that allows the lock arm to flex toward the housing main body portion.

* * * * *